United States Patent [19]

Tanaka et al.

[11] Patent Number: 5,034,371

[45] Date of Patent: Jul. 23, 1991

[54] THERMAL TRANSFER IMAGE RECORDING METHOD AND THERMAL TRANSFER DYE DONATING MATERIAL

[75] Inventors: Mitsugu Tanaka; Seiiti Kubodera, both of Kanagawa, Japan

[73] Assignee: Fuji Photo Film Co., Ltd., Kanagawa, Japan

[21] Appl. No.: 499,751

[22] Filed: Mar. 27, 1990

[30] Foreign Application Priority Data

Mar. 27, 1989 [JP] Japan ..... 1-74745
Jun. 29, 1989 [JP] Japan ..... 1-167971

[51] Int. Cl.[5] ..... B41M 5/035; B41M 5/26

[52] U.S. Cl. ..... 503/227; 8/411; 428/195; 428/913; 428/914

[58] Field of Search ..... 8/471; 428/195, 913, 428/914; 503/227

[56] References Cited

U.S. PATENT DOCUMENTS 4,541,830 9/1985 Hotta et al. ..... 8/471
4,829,047 5/1989 Niwa et al. ..... 503/227
4,885,272 12/1989 Chapman et al. ..... 503/227
4,910,187 3/1990 Sato et al. ..... 503/227

*Primary Examiner*—Bruce H. Hess
*Attorney, Agent, or Firm*—Sughrue, Mion, Zinn, Macpeak & Seas

[57] ABSTRACT

A method for recording a thermal transfer image comprising the step of transferring dyes which comprises a yellow dye represented by the general formula (I), a magenta dye represented by the general formula (II), and at least one of a cyan dye represented by the general formula (III) and a cyan dye represented by the general formula (IV), and a thermal transfer dye donating material which has on a support a color material layer containing at least one dye selected from among a yellow dye represented by the general formula (I), a magenta dye represented by the general formula (II), and a cyan dye represented by the general formula (III) and/or a cyand dye represented by the general formula (IV), together with a fluorine-containing compound:

(I)

wherein $R^1$ represents a hydrogen atom, an alkyl group, an alkoxy group, an aryl group, an alkoxycarbonyl group, a cyano group, or a carbamoyl group; $R^2$ represents a hydrogen atom, an alkyl group, or an aryl group; $R^3$ represents an aryl group, or a heterocyclyl group; and $R^4$ and $R^5$ each represents a hydrogen atom, or an alkyl group;

(II)

wherein $R^6$, $R^7$, $R^8$, $R^9$ and $R^{10}$ each represents a hydrogen atom, a halogen atom, an alkyl group, an alkoxy group, an aryl group, an aryloxy group, a cyano group, an acylamino group, a sulfonylamino group, an ureido group, an alkoxycarbonylamino group, an alkylthio group, an arylthio group, an alkoxycarbonyl group, a carbamoyl group, a sulfamoyl group, a sulfonyl group, an acyl group, or an amino group; $R^{11}$ and $R^{12}$ each represents a hydrogen atom, an alkyl group or an aryl group; or $R^{11}$ and $R^{12}$ may combine with each other to form a ring, or $R^{11}$ may combine with $R^8$ to form a ring and/or $R^{12}$ may combine with $R^9$ to form a ring; and X, Y and Z each represents or a nitrogen atom, wherein $R^{13}$ represents a hydrogen atom, an alkyl group, an aryl group, an alkoxy group, an aryloxy group, or an amino group; or when both X and Y, or both Y and Z are they may combine with each other to form a saturated or unsaturated carbon ring;

(III)

Q wherein Q represents atoms necessary to complete a carbon ring constituted by 5 or more member atoms, or a hetero ring constituted by 5 or more member atoms including at least one nitrogen atom; each substituent from $R^{14}$ and $R^{19}$ has the same meaning as each from $R^6$ to $R^{10}$; $R^{20}$ and $R^{21}$ each has the same meaning as $R^{11}$ or $R^{12}$; or $R^{20}$ and $R^{21}$ may combine with each other to form a ring, or $R^{20}$ may combine with $R^{17}$ to form a ring and/or $R^{21}$ may combine with $R^{18}$ to form a ring;

(Abstract continued on next page.)

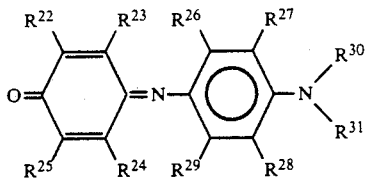
(IV)
wherein each substituent from $R^{22}$ to $R^{29}$ has the same meaning as each from $R^{6}$ to $R^{10}$; and $R^{30}$ and $R^{31}$ each has the same meaning as $R^{11}$ or $R^{12}$; or $R^{30}$ and $R^{31}$ may combine with each other to form a ring, or $R^{30}$ may combine with $R^{27}$ to form a ring and/or $R^{31}$ may combine with $R^{28}$ to form a ring.
3 Claims, No Drawings

THERMAL TRANSFER IMAGE RECORDING METHOD AND THERMAL TRANSFER DYE DONATING MATERIAL

FIELD OF THE INVENTION

This invention relates to a method of recording a thermal transfer image, and to a thermal transfer dye donating material.

BACKGROUND OF THE INVENTION

In the art of making color hard copies, thermal transfer processes, electrophotography, and ink jet processes are being studied energetically at present. Among these, heat transfer processes have many advantages because heat transfer apparatus are easily maintained and operated, and the apparatus and expendable supplies are relatively inexpensive. Processes and apparatuses for heat transfer process are disclosed, e.g., in U.S. Pat. No. 4,621,271.

There are two common methods of the thermal transfer process. One comprises heating a thermal transfer dye donating material having a heat fusible ink layer provided on a base film with a thermal head to melt the ink, and recording the image with the molten ink on a thermal transfer image receiving material. The second comprises heating a thermal transfer dye donating material having on a base film a color material layer containing a thermal transfer dye with a thermal head to transfer the dye into a thermal transfer image receiving material.

In the second process involving the thermal transfer, the amount of dye transferred can be varied by changing the energy applied to the thermal head. This makes gradation of the color transferred possible, which is especially advantageous in the full color recording of high quality images. The thermal transfer dyes used in this process, however, have various restrictions, and quite few dyes can satisfy all the required properties.

The required properties are, for example, spectral characteristics suitable for color reproduction, facility for thermal transfer, fastness to light and heat, resistance to various chemical reagents, no or slight decrease in sharpness, negligible retransfer of images, and facility for preparing a thermal transfer dye donating material.

Of particular interest were, three-color combinations of dyes, namely yellow, magenta and cyan dyes, which enabled the formation of full color images giving excellent color reproduction and light resistance. In addition, heat transfer dye donating materials that do not crease if deformed and do not adhere by the fusion to the heat transfer image receiving material when heated with the thermal head are also desired.

In the full color images obtained using known three-color combinations of dyes, namely yellow, magenta and cyan dyes, as thermal transfer dyes, neither the color reproduced nor the light fastness were satisfactory. In addition, deformation of these materials generates creases and the application of heat resulted in fused adhesion of the dye donating material to the heat transfer image receiving material.

SUMMARY OF THE INVENTION

One object of this invention is to provide a thermal transfer image recording method using a three-color combination of yellow, magenta and cyan dyes which can obviate the above-described defects.

Another object of this invention is to provide a thermal transfer dye donating material which contains at least one novel yellow, magenta or cyan dye and a fluorine-containing compound to obviate the above-described defects.

These and other objects of this invention are attained with a method for recording a thermal transfer image comprising the step of transferring dyes which comprises a yellow dye represented by the general formula (I), a magenta dye represented by the general formula (II), and at least one of a cyan dye represented by the general formula (III) and a cyan dye represented by the general formula (IV), and a thermal transfer dye donating material which has on a support a color material layer containing at least one dye selected from among a yellow dye represented by the general formula (I), a magenta dye represented by the general formula (II), and a cyan dye represented by the general formula (III) and/or a cyan dye represented by the general formula (IV), together with a fluorine-containing compound:

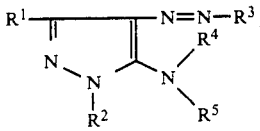

(I)

wherein $R^1$ represents a hydrogen atom, an alkyl group, an alkoxy group, an aryl group, an alkoxycarbonyl group, a cyano group, or a carbamoyl group; $R^2$ represents a hydrogen atom, an alkyl group, or an aryl group; $R^3$ represents an aryl gorup, or a heterocyclyl group; and $R^4$ and $R^5$ each represents a hydrogen atom, or an alkyl group;

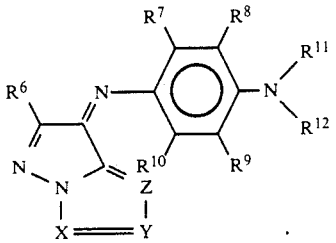

(II)

wherein $R^6$, $R^7$, $R^8$, $R^9$ and $R^{10}$ each represents a hydrogen atom, a halogen atom, an alkyl group, an alkoxy group, an aryl group, an aryloxy group, a cyano group, an acylamino group, a sulfonylamino group, an ureido group, an alkoxycarbonylamino group, an alkylthio group, an arylthio group, an alkoxycarbonyl group, a carbamoyl group, a sulfamoyl group, a sulfonyl group, an acyl group, or an amino group; $R^{11}$ and $R^{12}$ each represents a hydrogen atom, an alkyl group or an aryl group; or $R^{11}$ and $R^{12}$ may combine with each other to form a ring, or $R^{11}$ may combine with $R^8$ to form a ring and/or $R^{12}$ may combine with $R^9$ to form a ring; and X, Y and Z each represents

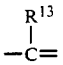

or a nitrogen atom, wherein $R^{13}$ represents a hydrogen atom, an alkyl group, an aryl group, an alkoxy group, an aryloxy group, or an amino group; or when both X and Y, or both Y and Z are

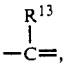

they may combine with each other to form a saturated or unsaturated carbon ring;

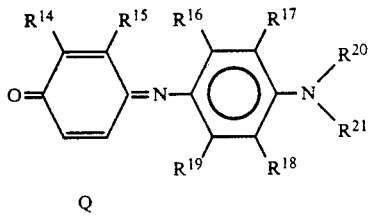

(III)

wherein Q represents atoms necessary to complete a carbon ring constituted by 5 or more member atoms, or a hetero ring constituted by 5 or more member atoms including at least one nitrogen atom; each substituent from $R^{14}$ to $R^{19}$ has the same meaning as each from $R^6$ to $R^{10}$; $R^{20}$ and $R^{21}$ each has the same meaning as $R^{11}$ or $R^{12}$; or $R^{20}$ and $R^{21}$ may combine with each other to form a ring, or $R^{20}$ may combine with $R^{17}$ to form a ring and/or $R^{21}$ may combine with $R^{18}$ to form a ring;

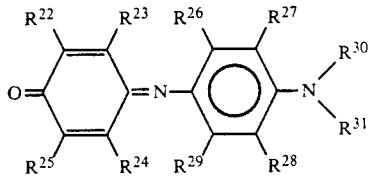

(IV)

wherein each substituent from $R^{22}$ to $R^{29}$ has the same meaning as each from $R^6$ to $R^{10}$; and $R^{30}$ and $R^{31}$ each has the same meaning as $R^{11}$ or $R^{12}$; or $R^{30}$ and $R^{31}$ may combine with each other to form a ring, or $R^{30}$ may combine with $R^{27}$ to form a ring and/or $R^{31}$ may combine with $R^{28}$ to form a ring.

DETAILED DESCRIPTION OF THE INVENTION

The dyes represented by the general formulae (I) to (IV) are illustrated in detail below.

In general formula (I), the substituents have the following meaning:

$R^1$ represents a hydrogen atom, an alkyl group (which may be substituted or unsubstituted, preferable examples are groups containing 1 to 12 carbon atoms such as methyl, ethyl, isopropyl, butyl, methoxyethyl, etc.), an alkoxy group (which may be substituted or unsubstituted, preferable examples are groups containing 1 to 12 carbon atoms such as methoxy, ethoxy, isopropoxy, methoxyethoxy, etc.), an aryl group (which may be substituted or unsubstituted, preferable examples are groups containing 6 to 15 carbon atoms such as phenyl, p-tolyl, p-methoxyphenyl, p-chlorophenyl, o-methoxyphenyl, etc.), an alkoxycarbonyl group (which may be substituted or unsubstituted, preferable examples are groups containing 2 to 12 carbon atoms such as methoxycarbonyl, ethoxycarbonyl, butoxycarbonyl, etc.), a cyano group, or a carbamoyl group (which may be substituted or unsubstituted, preferable examples are groups containing 1 to 12 carbon atoms such as methylcarbamoyl, dimethylcarbamoyl, butylcarbamoyl, phenylcarbamoyl, etc.).

Among these groups, alkyl groups containing 1 to 4 carbon atoms are particularly preferable.

$R^2$ represents a hydrogen atom, an alkyl group (which may be substituted or unsubstituted, preferable examples are groups containing 1 to 12 carbon atoms such as methyl, ethyl, isopropyl, butyl, methoxyethyl, cyanoethyl, benzyl, etc.), or an aryl group (which may be substituted or unsubstituted, preferable examples are groups containing 6 to 25 carbon atoms such as phenyl, p-tolyl, p-methoxyphenyl, p-chlorophenyl, o-methoxyphenyl, p-nitrophenyl, p-acetylaminophenyl, 2.5-dichlorophenyl, m-propionylaminophenyl, etc.). Among these groups, methyl group and phenyl group are particularly preferable.

$R^3$ represents an aryl group (which may be substituted or unsubstituted, preferable examples are groups containing 6 to 25 carbon atoms such as phenyl groups having as a substituent group an alkyl group, an alkoxy group, an aryloxy group, an aralkyl group, an aryl group, a halogen atom, cyano group, nitro group, an ester group, a carbamoyl group, an acyl group, an acylamino group, a sulfonyl group, a sulfamoyl group, an sulfonamido group, an amino group, an alkylamino group, an arylamino group, or hydroxyl group), or a heterocyclyl group (which may be substituted or unsubstituted, preferable examples are groups containing 3 to 12 carbon atoms such as imidazolyl, pyridyl, pyrazolyl, thiazolyl, benzimdazolyl, quinolyl, benzopyrazolyl,benzothiazolyl,isothiazolyl,benzisothiazolyl, pyridoisothiazolyl, etc., which each may be substituted, e.g., by alkyl, alkoxy, aryloxy, aralkyl, aryl, halogen, cyano, nitro, ester, carbamoyl, acyl, acylamino, sulfonyl, sulfamoyl, sulfonamido, amino, alkylamino, arylamino, hydroxyl or so on).

Among these groups, phenyl groups substituted by from one to three electron-attracting groups (e.g., halogen, cyano, nitro, carbamoyl, acyl, sulfonyl, sulfamoyl) are particularly preferable.

$R^4$ and $R^5$ each represent a hydrogen atom or an alkyl group (which may be substituted or unsubstituted, preferable examples are groups containing 1 to 12 carbon atoms such as methyl, ethyl, isopropyl, butyl, methoxyethyl, etc.).

It is preferred that both $R^4$ and $R^5$ are hydrogen atoms.

Specific examples of dyes represented by general formula (I) in this invention are illustrated below. However, the invention should not be construed as being limited to these examples.

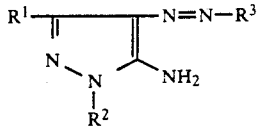
| Dye No. | $R^1$ | $R^2$ | $R^3$ |
|---|---|---|---|
| 1 | $-CH_3$ | 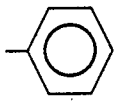 | 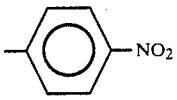 |
| 2 | " | 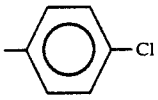 | 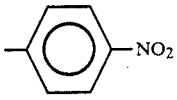 |
| 3 | " | 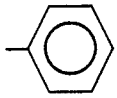 | 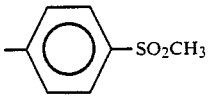 |
| 4 | " | " | 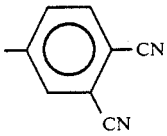 |
| 5 | " | " | 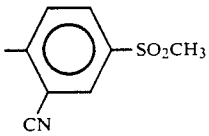 |
| 6 | " | " | 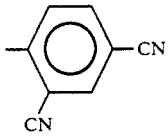 |
| 7 | $-CH_3$ | 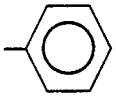 | 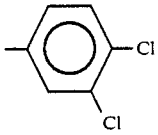 |
| 8 | " | " | 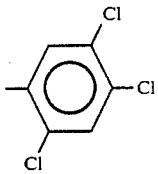 |
| 9 | " | " | 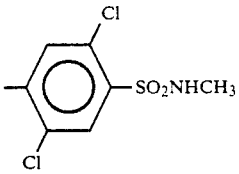 |

-continued
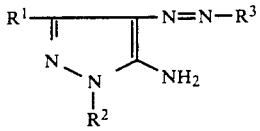
| Dye No. | $R^1$ | $R^2$ | $R^3$ |
|---|---|---|---|
| 10 | " | " | 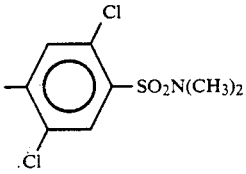 |
| 11 | $-CH_3$ | 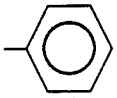 | 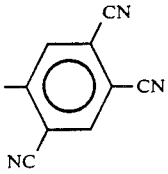 |
| 12 | " | " | 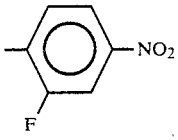 |
| 13 | " | " | 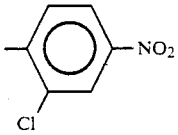 |
| 14 | " | " | 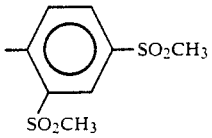 |
| 15 | " | " | 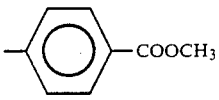 |
| 16 | " | " | 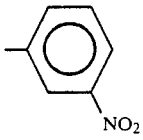 |
| 17 | $-C_2H_5$ | 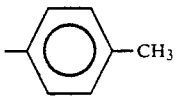 | 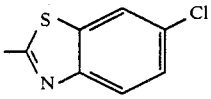 |
| 18 | 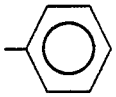 | 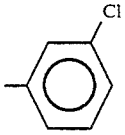 | 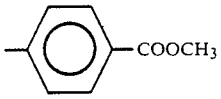 |

-continued
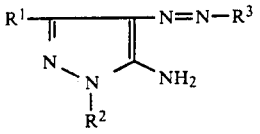
| Dye No. | $R^1$ | $R^2$ | $R^3$ |
|---|---|---|---|
| 19 | " | $-CH_3$ | 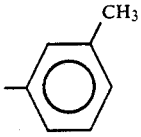 |
| 20 | $-COOC_2H_5$ | $-CH_2CH_2CN$ | 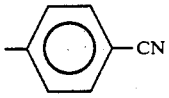 |
| 21 | $-CONHCH_3$ | 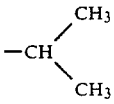 | 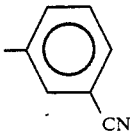 |
| 22 | " | 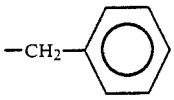 | 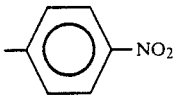 |
| 23 | $-CH_3$ | 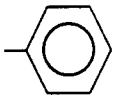 | 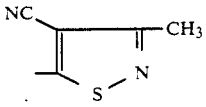 |
| 24 | 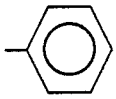 | 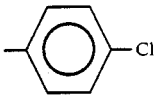 | 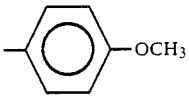 |
| 25 | $-OCH_3$ | 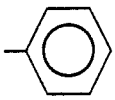 | 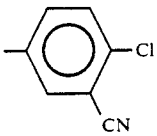 |
| 26 | $-OC_2H_5$ | 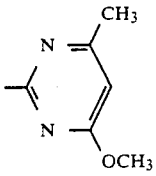 | 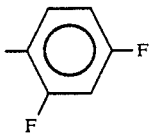 |
| 27 | $-C_4H_9(t)$ | 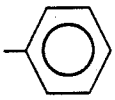 | 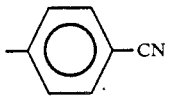 |
| 28 | $-CH_3$ | 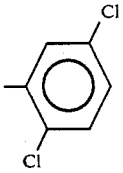 | 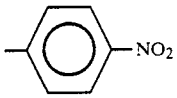 |

-continued
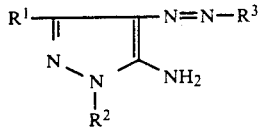
| Dye No. | $R^1$ | $R^2$ | $R^3$ |
|---|---|---|---|
| 28-a | $-CH_3$ | 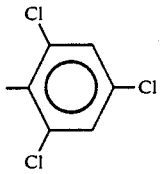 | 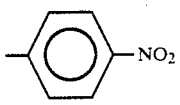 |
| 28-b | " | " | 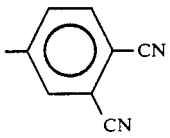 |
| 28-c | " | 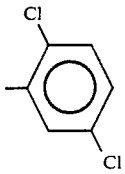 | " |
| 28-d | " | 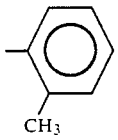 | " |
| 28-e | $-CH_3$ | 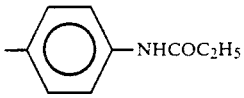 | 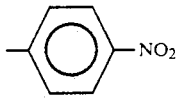 |
| 28-f | " | 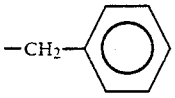 | 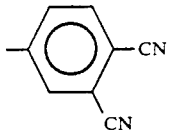 |
| 28-g | $(CH_3)_3C-$ | 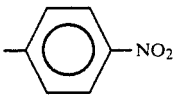 | 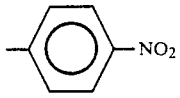 |
| 28-h | " | 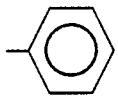 | 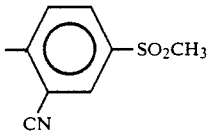 |
| C-29 | $CH_3$ | 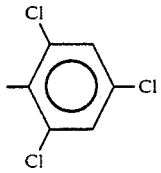 | 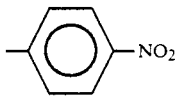 |

-continued

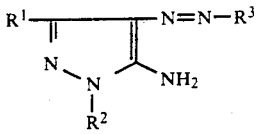

| Dye No. | $R^1$ | $R^2$ | $R^3$ |
|---|---|---|---|
| C-30 | " | " | 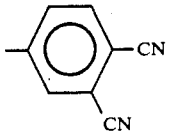 |
| C-31 | " | 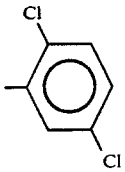 | " |
| C-32 | " | 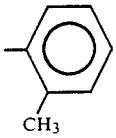 | " |
| C-33 | " | 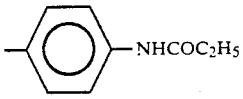 | 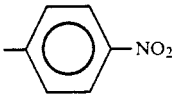 |
| C-34 | " | 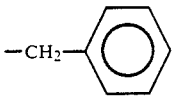 | 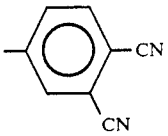 |
| C-35 | $(CH_3)_3C$ | 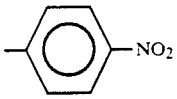 | 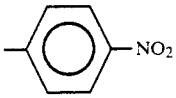 |
| C-36 | " | 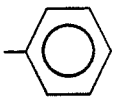 | 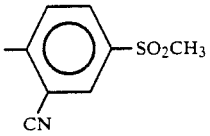 |

Particularly preferable compounds among those represented by general formula (I) are Nos. 1, 4, 9, 28-a, and 28-b.

Yellow dyes of this invention can be obtained by diazotizing $R^3$-$NH_2$, and allowing the resulting diazonium salt to couple with the pyrazole compounds illustrated below:

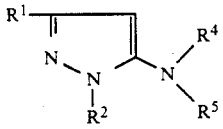

Magenta dyes of general formula (II) are illustrated in detail below.

$R^6$ to $R^{10}$ each represent a hydrogen atom, a halogen atom (e.g., fluorine, chlorine, bromine), an alkyl group (which may be substituted or unsubstituted, preferable examples are groups containing 1 to 12 carbon atoms such as methyl, ethyl, butyl, isopropyl, t-butyl, hyiroxyethyl, methoxyethyl, cyanoethyl, trifluoromethyl, cyclopentyl, cyclohexyl, benzyl, 2-phenetyl, 2-acetylaminoethyl, 1-methyl-2-benzoylaminoethyl, 1-methyl-2-phthalimidoethyl, etc.), an alkoxy group (which may be substituted or unsubstituted, preferable examples are groups containing 1 to 12 carbon atoms such as methoxy, ethoxy, isopropoxy, methoxyethoxy, hydroxyethoxy, etc.), an aryl group (which may be substituted or unsubstituted, preferable examples are groups containing 6 to 12 carbon atoms such as phenyl, p-tolyl, p-methoxyphenyl, p-chlorophenyl, o-methoxyphenyl, etc.), an aryloxy group (which may be substituted or unsubstituted, preferable examples are groups containing 6 to 12 carbon atoms such as phenoxy, p-methylphenoxy, p-methoxyphenoxy, o-methoxyphenoxy, etc.), cyano group, an acylamino group (which may be substituted or unsubstituted, preferable examples are groups containing 2 to 12 carbon atoms, such as acetylamino, propionylamino, isobutyroylamino, etc.), a sulfonylamino group (which may be substituted or unsubstituted, preferable examples are groups containing 1 to 12 carbon atoms, such as methanesulfonylamino, benzenesulfonylamino, trifluoromethanesulfonylamino, etc.), an ureido group (which may be substituted or unsubstituted, preferable examples are groups containing 1 to 12 carbon atoms, such as 3-methylureido, 3,3-dimethylureido, 1,3-dimethylureido, etc.), an alkoxycarbonylamino group (which may be substituted or unsubstituted, preferable examples are groups containing up to 12 carbon atoms such as methoxycarbonylamino, ethoxycarbonylamino, butoxycarbonylamino, etc.), an alkylthio group (which may be substituted or unsubstituted, preferable examples are groups containing up to 12 carbon atoms such as methylthio, butylthio, etc.), an arylthio group (which may be substituted or unsubstituted, preferable examples are groups containing up to 12 carbon atoms such as phenylthio, p-tolylthio, etc.), an alkoxycarbonyl group (which may be substituted or unsubstituted, preferable examples are groups containing up to 12 carbon atoms such as methoxycarbonyl, ethoxycarbonyl, etc.), a carbamoyl group (which may be substituted or unsubstituted, preferable examples are groups containing 1 to 12 carbon atoms, such as methylcarbamoyl, ethylcarbamoyl, phenylcarbamoyl, dimethylcarbamoyl, etc.), a sulfamoyl group (which may be substituted or unsubstituted, preferable examples are groups containing 1 to 12 carbon atoms, such as dimethylsulfamoyl, diethylsulfamoyl, etc.), a sulfonyl group (which may be substituted or unsubstituted, preferable examples are groups containing 1 to 12 carbon atoms, such as methanesulfonyl, butanesulfonyl, phenylsulfonyl, etc.), an acyl group (which may be substituted or unsubstituted, preferable examples are groups containing 1 to 12 carbon atoms, such as acetyl, butyroyl, trifluoroacetyl, etc.), or an amino group (which may be substituted or unsubstituted, preferable examples are groups containing 0 to 12 carbon atoms, such as methylamino, dimethylamino, etc.).

Among the above-cited substituents, those particularly preferred as $R^6$ are alkyl groups having not more than 8 carbon atoms, alkoxy groups having not more than 8 carbon atoms and aryl groups having from 6 to 12 carbon atoms, those particularly preferred as $R^7$ are hydrogen atoms, alkyl groups having not more than 4 carbon atoms, alkoxy groups having not more than 4 carbon atoms, halogen atoms, acylamino groups having not more than 7 carbon atoms and alkoxycarbonylamino groups having not more than 7 carbon atoms, and those particularly preferred as $R^8$, $R^9$ and $R^{10}$ are hydrogen atom.

$R^{11}$ and $R^{12}$ each represent a hydrogen atom, an alkyl group (which may be substituted or unsubstituted, preferable examples are groups containing 1 to 12 carbon atoms such as methyl, ethyl, propyl, isopropyl, t-butyl, hexyl, cyclopentyl, cyclohexyl, benzyl, 2-phenetyl, 2-hydroxyethyl, 2-methoxyethyl, cyanomethyl, 2-cyanoethyl, 2-methoxycarbonylethyl, 2-ethoxycarbonylethyl, 2-methoxycarbonyloxyethyl, 2-ethoxycarbonylaminoethyl, 2-(N-methylaminocarbonylamino)ethyl, 2-methylcarbamoylethyl, 3-dimethylcarbamoylethyl, 2-ethylsulfonylethyl, 3-acetyloxypropyl, isobutyroyloxyethyl, 2-acetylethyl, etc.), or an aryl group (which may be substituted or unsubstituted, preferable examples are groups containing 6 to 12 carbon atoms such as phenyl, p-tolyl, etc.).

Preferred combinations of $R^{11}$ and $R^{12}$ include such a case that both $R^{11}$ and $R^{12}$ are unsubstituted alkyl groups containing 1 to 6 carbon atom, and such a case that $R^{11}$ is an alkyl group containing 2 to 10 carbon atoms and a substituent group (e.g., cyano, sulfonyl, alkoxy, acylamino, sulfonylamino, alkoxycarbonyl or acyloxycarbonyl), and $R^{12}$ is an unsubstituted alkyl group containing 1 to 6 carbon atoms.

In addition, such a case that $R^{11}$ and $R^{12}$ combine with each other to form a ring (e.g.,

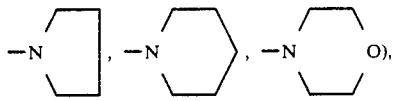

and such a case that $R^{11}$ may combine with $R^8$ to form a ring and/or $R^{12}$ may combine with $R^9$ to form a ring to form a ring (e.g.,

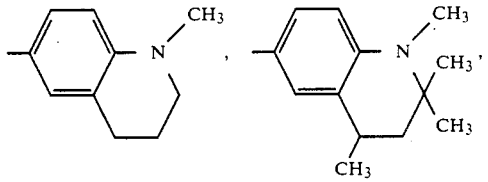

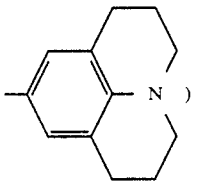

are given as preferred examples

X, Y and Z each represent

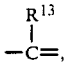

or nitrogen (—N=), and $R^{13}$ represents a hydrogen atom, an alkyl group, a cycloalkyl group, an aralkyl group, an aryl group, an alkoxy group, an aryloxy group, or an amino group (as specific examples of these groups, mention may be made of those described respecting $R^6$ to $R^{10}$).

Examples of desirable combinations of X, Y and Z, are cases in which all of them are —N=, two of them are —N=, and only one of them is —B=. In particular, the case where all of them are —B= and the case that two of them are —B= are preferred.

Specific examples of preferred dyes among those represented by general formula (II) of this invention are illustrated below.

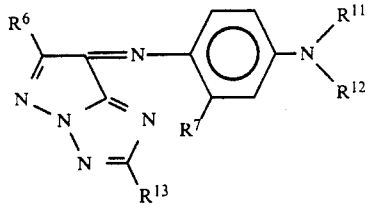

| Dye No. | $R^6$ | $R^7$ | $R^{11}$ | $R^{12}$ | $R^{13}$ |
|---|---|---|---|---|---|
| 29 | 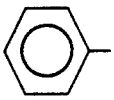 | H | $-CH_2CH_2CN$ | $-C_2H_5$ | $CH_3$ |
| 30 | $(CH_3)_3C-$ | " | " | " | 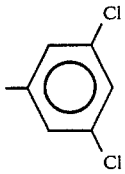 |
| 31 | $CH_3$ | " | " | " | " |
| 32 | " | $CH_3$ | " | " | $CH_3$ |
| 33 | $CH_3$ | H | " | " | " |
| 34 | " | " | $-CH_2CH_2COOC_2H_5$ | " | $-\underset{\underset{CH_3}{\vert}}{CH}-CH_2NHCOCH_3$ |
| 35 | " | " | $-CH_2CH_2OCOCH_3$ | " | $-\underset{\underset{CH_3}{\vert}}{CH}-CH_2NHCOC_2H_5$ |
| 36 | " | $CH_3$ | " | $-C_3H_7$ | $-C(CH_3)_3$ |
| 37 | $(CH_3)_3C-$ | " | $-CH_2CH_2CN$ | $-C_2H_5$ | 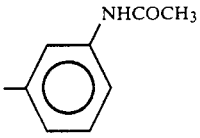 |
| 38 | " | " | " | " | 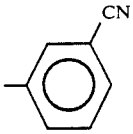 |
| 39 | $(CH_3)_3C-$ | H | $-CH_2CH_2SO_2CH_3$ | $-C_2H_5$ | 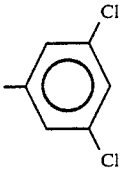 |
| 40 | $CH_3$ | $-NHCOCH_3$ | $-CH_2CH_2CN$ | " | $C_2H_5$ |
| 41 | " | $-NHCOOCH_3$ | " | " | $-CH(CH_3)_2$ |
| 42 | " | $CH_3$ | $-CH_2CH_2OCOC_2H_5$ | $-CH_2CH_2OCOC_2H_5$ | 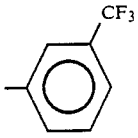 |
| 43 | 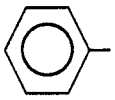 | H | $-CH_2CH_2CN$ | $-C_2H_5$ | 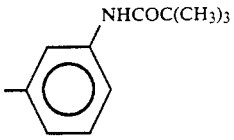 |

-continued

| | | | | | |
|---|---|---|---|---|---|
| 44 | $CH_3$ | $CH_3$ | $-CH_2COOC_2H_5$ | " | 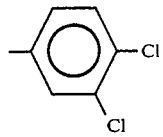 |
| 45 | " | " | $-CH_2CH_2Cl$ | " | " |
| 46 | $C_2H_5O-$ | " | $-CH_2CH_2CONHC_2H_5$ | " | $-CH_2CH_2NHSO_2CH_3$ |
| 47 | 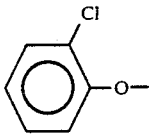 | H | $-CH_2CH_2OCOCH_3$ | $-C_4H_9$ | 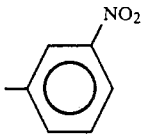 |
| 48 | $(CH_3)_3C-$ | H | $-C_2H_5$ | $-C_2H_5$ | $-CH_3$ |
| 49 | $C_2H_5-$ | $CH_3$ | H | $-C_4H_9$ | " |
| 50 | $(CH_3)C-$ | H | $-C_2H_5$ | $-C_2H_5$ | 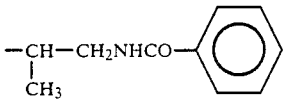 |
| 51 | " | " | " | " | 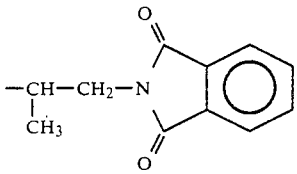 |
| 52 | " | F | " | " | $-CH_2CH_2NHCOC(CH_3)_2$ |
| 53 | " | H | " | " | 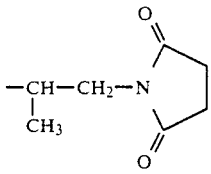 |

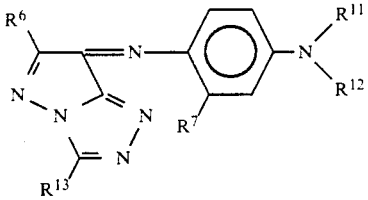

| Dye No. | $R^6$ | $R^7$ | $R^{11}$ | $R^{12}$ | $R^{13}$ |
|---|---|---|---|---|---|
| 54 | $CH_3$ | $CH_3$ | $-CH_2CH_2CN$ | $C_2H_5$ | $CH_3$ |
| 55 | $-CH(CH_3)_2$ | " | $-CH_2CH_2OCOC_2H_5$ | " | " |
| 56 | $CH_3$ | " | $-CH_2CH_2COOC_2H_5$ | $C_3H_7$ | $-CH_2CH_2SO_2CH_3$ |
| 57 | " | H | " | $C_2H_5$ | 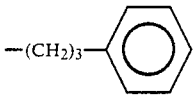 |
| 58 | " | $CH_3$ | $-CH_2CH_2OCOC_2H_5$ | " | $-CH_2CH_2OCH_3$ |
| 59 | $-CH(CH_3)_2$ | " | $-CH_2CH_2CN$ | " | $-CH_2CH_2SO_2CH_3$ |
| 60 | $-C(CH_3)_3$ | H | $-C_2H_5$ | " | $CH_3$ |

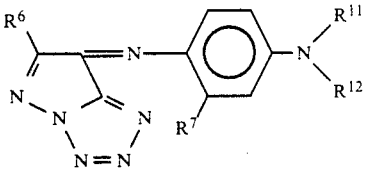

-continued
| Dye No. | $R^6$ | $R^7$ | $R^{11}$ | $R^{12}$ |
|---|---|---|---|---|
| 61 | $CH_3$ | H | $-CH_2CH_2OCOC_2H_5$ | $C_2H_5$ |
| 62 | " | $CH_3$ | $-CH_2CH_2CN$ | $CH_3$ |
| 63 | " | H | $-CH_2CH_2COOCH_3$ | $C_2H_5$ |
| 64 | $-CH(CH_3)_2$ | " | " | " |
| 65 | $-C(CH_3)_3$ | " | " | " |
| 66 | 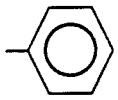 | " | $-CH_2CH_2CN$ | " |
| 67 | $-C(CH_3)_3$ | " | $-C_2H_5$ | " |
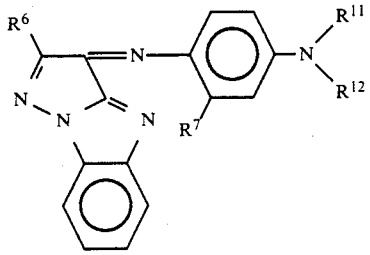
| Dye No. | $R^6$ | $R^7$ | $R^{11}$ | $R^{12}$ |
|---|---|---|---|---|
| 68 | $CH_3$ | $CH_3$ | $-CH_2CH_2OCOC_2H_5$ | $C_2H_5$ |
| 69 | $-C(CH_3)_3$ | " | $-CH_2CH_2COOC_2H_5$ | " |
| 70 | 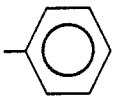 | " | $-CH_2CH_2CN$ | " |
| 71 | " | H | $-CH_2CH_2COOC_3H_7$ | " |
| 72 | $-OC_2H_5$ | $CH_3$ | " | " |
| 73 | $-C(CH_3)_3$ | H | $-C_2H_5$ | " |
74
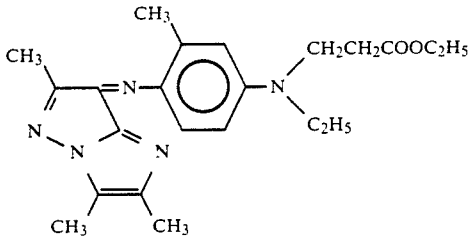
75
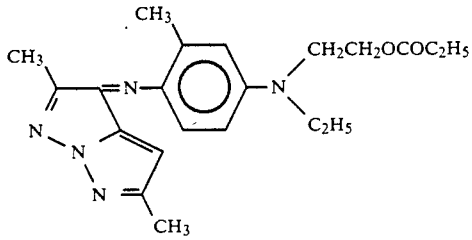
76
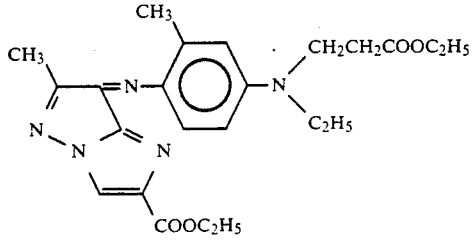

Particularly preferable compounds among those represented by general formula (II) are Nos. 29, 30, 34, 43, 50, and 51.

Preparation of magenta dyes represented by general formula (II) of this invention is described below.

The dyes represented by general formula (II) can be prepared by the oxidative coupling of ring-condensed pyrazole derivatives of general formula (V) with p-phenylenediamine derivatives of formula (VI), or the dehydration-condensation reaction of pyrazole derivatives of general formula (V) with nitroso compounds of general formula (VII) as discussed below.

Scheme 1:

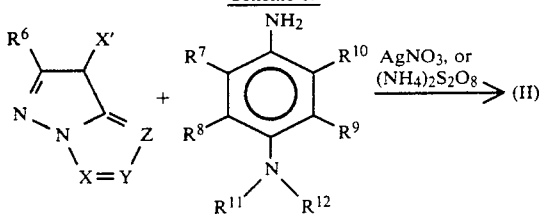

(V) (VI)

(X' = H or a coupling-off group)

Scheme 2:

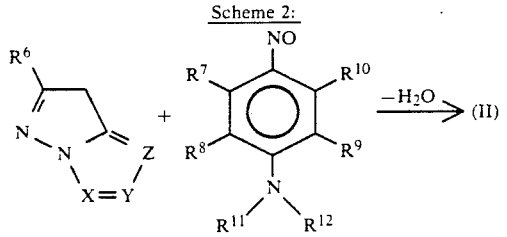

(VII)

The ring-condensed pyrazole derivatives of general formula (V) can be synthesized in accordance with various methods known in the art.

For instance, 1H-pyrazolo(1,5-b)(1,2,4)triazole compounds of the general formula (VIII) illustrated below can be synthesized according to the method described in JP-A-61-261738 (The term "JP-A" as used herein means an "unexamined published Japanese patent application"), and so on.

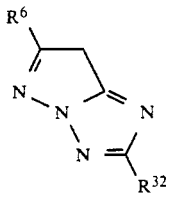

(VIII)

In the formula (VIII), $R^6$ has the same meanings as defined in formula (II) and $R^{32}$ represents a hydrogen atom, an alkyl group, an aryl group, an alkoxy group, an aryloxy group, or an amino group.

The reaction of the compound (VIII) with the compound (VI) or (VII) can proceed under mild conditions to produce the desired dye of general formula (II) at a high yield.

Cyan dyes of general formula (III) are described in detail below.

When the skeleton of the ring containing Q is made up of carbon atoms alone, those completing a 6-membered ring represented by the general formula (IX) are preferred. In the formula (IX), substituents from have the same meanings as the substituents from $R^6$ to $R^{10}$ in the general formula (II). It is particularly preferred that each of $R^{33}$ to $R^{36}$ represent a hydrogen atom.

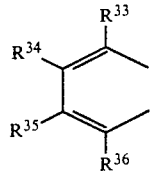

(IX)

When the skeleton of the ring comprising Q contains at least one nitrogen atom, those represented by the structural formulae (X) and (XI) respectively are preferred.

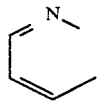

(X)

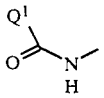

(XI)

In the formula (XI), $Q^1$ represents a divalent amino group, an ether group, a thioether group, an alkylene group, an ethylene group, an imino group, a sulfonyl group, a carbonyl group, an arylene group, a divalent heterocyclic group, or a combination of two or more thereof. Among these groups,

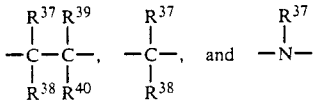

are preferred.

Herein, the substituents from $R^{37}$ to $R^{40}$ can be hydrogen atoms, and groups by which the carbon or nitrogen atom can be substituted (e.g., alkyl groups containing 1 to 6 carbon atoms, aryl groups containing 6 to 10 carbon atoms, halogen atoms).

Substituents from $R^{14}$ to $R^{19}$ have the same meanings as those from $R^6$ to $R^{10}$.

When Q is the group represented by formula (IX) or (X), the groups preferred as $R^{14}$ include carbamoyl groups containing from 2 to 8 carbon atoms (e.g., methylcarbamoyl, ethylcarbamoyl, butylcarbamoyl, isopropylcarbamoyl, t-butylcarbamoyl, cyclopentylcarbamoyl, cyclohexylcarbamoyl, methoxyethylcarb amoyl, chloroethylcarbamoyl, cyanoethylcarbamoyl, benzylcarbamoyl, furfurylcarbamoyl, tetrahydrofurfurylcarbamoyl, phenoxymethylcarbamoyl, allylcarbamoyl, phenylcarbamoyl, 2-pyridylcarbamoyl). When Q is the group represented by formula (XI), the groups preferred as $R^{14}$ include acylamino groups containing 1 to 10 carbon atoms (e.g., acetylamino, propionylamino, isobutyroylamino, hexahydrobenzoylamino, pivaloylamino, trifluoroacetylamino, heptafluorobutyroylamino, chloropropionylamino, cyanoacetylamino, phenoxyacetylamino, acryloylamino, benzoylamino, p-trifluoromethylbenzoylamino, picolinoylamino, nicotinoylamino, thenoylamino, furoylamino).

Among the atoms and the substituents represented by $R^{15}$, $R^{17}$, $R^{18}$ and $R^{19}$, hydrogen atoms are preferred.

Among the atoms and the substituents represented by $R^{16}$, a hydrogen atom, alkyl groups containing from 1 to 4 carbon atoms, alkoxy groups containing from 1 to 4 carbon atoms, halogen atoms (e.g., fluorine, chlorine), acylamino groups containing from 1 to 4 carbon atoms, sulfonylamio groups containing from 1 to 4 carbon atoms, and alkoxycarbonylamino groups containing from 2 to 5 carbon atoms are preferred.

$R^{20}$ and $R^{21}$ have the same meanings as $R^{11}$ and $R^{12}$. Examples of a preferred combination of $R^{20}$ and $R^{21}$ include the case where both $R^{20}$ and $R^{21}$ are an unsubstituted alkyl group containing from 1 to 6 carbon atoms, and the case where $R^{20}$ is an alkyl group containing from 20 to 10 carbon atoms and a substituent group (e.g., cyano, alkoxy, hydroxyl, acylamino, halogen alkoxycarbonyl, alkoxycarbonyloxy, alkoxycarbonylamino, aminocarbonylamino, carbamoyl, acyloxy, acyl), and $R^{21}$ is an unsubstituted alkyl group containing from 1 to 6 carbon atoms. $R^{20}$ and $R^{21}$ may combine with each other to form a ring, or $R^{20}$ may combine with $R^{17}$ to form a ring and/or $R^{21}$ may combine with $R^{18}$ to form a ring.

Specific examples of the dyes represented by general formula (III) of this invention are illustrated below.

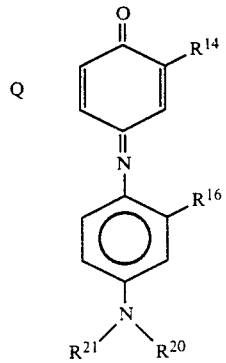

| Dye No. | Q | $R^{14}$ | $R^{16}$ | $R^{20}$ | $R^{21}$ |
|---|---|---|---|---|---|
| 77 | 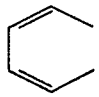 | $-CONHCH_3$ | H | $-C_2H_5$ | $-C_2H_5$ |
| 78 | " | " | " | " | $-C_2H_4OCH_3$ |
| 79 | " | $-CONHC_2H_5$ | $-CH_3$ | " | $-C_2H_4CN$ |
| 80 | " | $-CONHC_3H_7$-iso | $-OCH_3$ | $-C_3H_7$ | " |
| 81 | " | $-CONHCH_3$ | $-NHCOCH_3$ | $-C_2H_4OCOCH_3$ | $-C_2H_4OCOCH_3$ |
| 82 | " | " | $-NHCOOCH_3$ | $-C_2H_5$ | " |
| 83 | " | 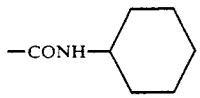 | $CH_3$ | $-C_2H_5$ | $-C_2H_4NHSO_2CH_3$ |
| 84 | " | $-CONHC_4H_9$ | " | " | $-C_2H_4NHCOCH_3$ |
| 85 | " | 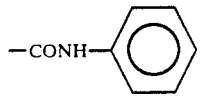 | H | " | $-C_2H_4COOC_2H_5$ |
| 86 | 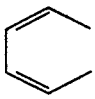 | $-CONHCH_3$ | F | H | $-C_2H_5$ |
| 87 | " | 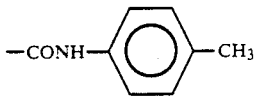 | $CH_3$ | $-CH_3$ | $-CH_3$ |
| 88 | 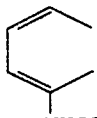 | $-CONHCH_3$ | H | $-C_2H_5$ | $-C_2H_5$ |

-continued

Q 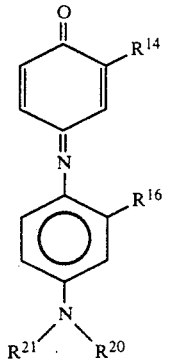

| Dye No. | Q | $R^{14}$ | $R^{16}$ | $R^{20}$ | $R^{21}$ |
|---|---|---|---|---|---|
| 89 | 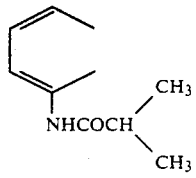 | " | " | " | " |
| 90 | 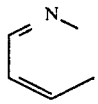 | " | " | " | " |
| 91 | 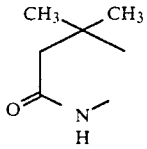 | $-NHCOCF_3$ | $-CH_3$ | $-C_2H_5$ | $-C_2H_5$ |
| 92 | " | " | " | $-C_2H_5$ | $-C_2H_4OH$ |
| 93 | " | " | " | " | $-C_2H_4OCH_3$ |
| 94 | 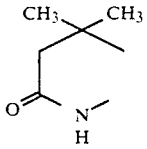 | $-NHCOCF_3$ | $-CH_3$ | $-C_2H_5$ | $-C_2H_4OCOCH_3$ |
| 95 | " | " | " | " | $-C_2H_4COOC_2H_5$ |
| 96 | " | " | " | " | $-C_2H_4NHSO_2CH_3$ |
| 97 | " | $-NHCOC_3F_7$ | $-C_2H_5$ | $-CH_3$ | $-CH_2COOC_3H_7$ |
| 98 | " | $-NHCOCH_3$ | $-NHCOCH_3$ | $-C_2H_5$ | $-C_2H_5$ |
| 99 | " | $-NHCOC_3H_7$-iso | " | " | " |
| 100 | " | $-NHCOC_4H_9$-t | " | " | " |
| 101 | " | " | $-NHCOOCH_3$ | " | " |
| 102 | " | " | " | " | $-C_2H_4OCH_3$ |
| 103 | " | " | $-NHCOC_3H_7$-iso | " | $-C_2H_5$ |
| 104 | " | $-NHCO-$ 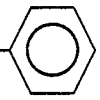 | $-OCH_3$ | " | $-C_2H_4CN$ |
| 105 | 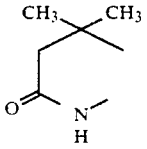 | $-NHCOCF_3$ | H | $-C_3H_7$ | $-C_3H_7$ |
| 106 | " | " | $-NHCOCH_3$ | $-C_2H_5$ | H |

-continued
Q 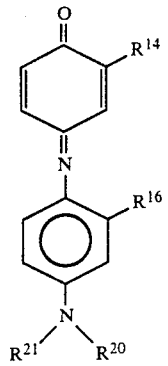
| Dye No. | Q | $R^{14}$ | $R^{16}$ | $R^{20}$ | $R^{21}$ |
|---|---|---|---|---|---|
| 107 | " | 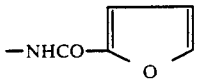 | $-CH_3$ | " | $-C_2H_5$ |
| 108 | 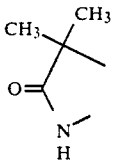 | $-NHCOCF_3$ | $-CH_3$ | " | " |
| 109 | " | $-NHCOC_4H_9$-t | $-NHCOOCH_3$ | " | " |
| 110 | " | " | " | $-C_2H_4OCH_3$ | $-C_2H_4OCH_3$ |
No. 111
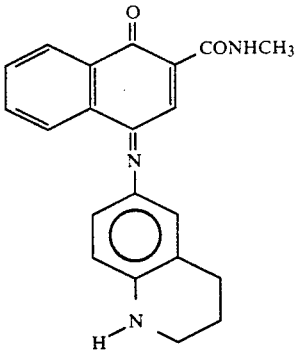
No. 112
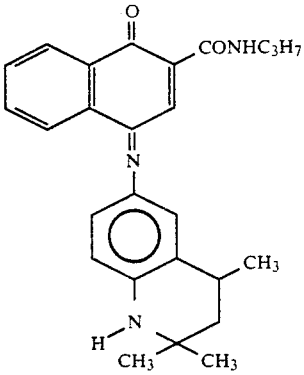

-continued

Q 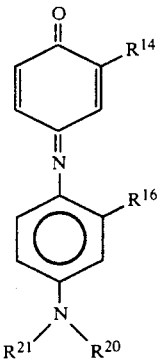

| Dye No. | Q | $R^{14}$ | $R^{16}$ | $R^{20}$ | $R^{21}$ |
|---|---|---|---|---|---|
| No. 113 | 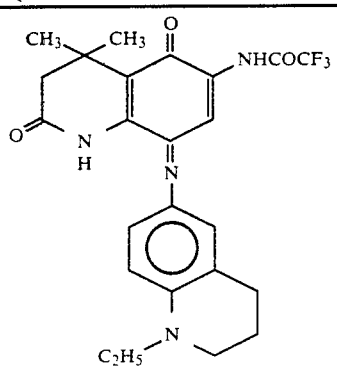 | | | | |

Particularly preferable compounds among those represented by general formula (III) are Nos. 77, 91, 92, 93, 94, and 95.

Dyes of the general formula (III) can be obtained by the oxidative coupling of compounds represented by general formula (XII) with compounds represented by general formula (XIII), or by the dehydration-condensation reaction of compounds represented by general formula (XIV) with compounds represented by general formula (XV).

(XII)

Q 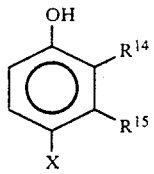

(X = H or a coupling-off group)

(XIII)

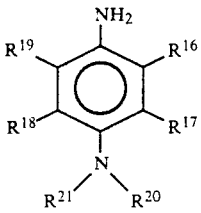

(XIV)

Q 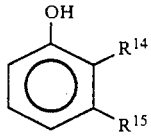

-continued (XV)

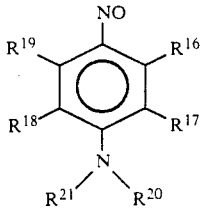

Dyes of the general formula (IV) are described in detail below.

$R^{22}$ to $R^{29}$ have the same meanings as $R^6$ to $R^{10}$. Substituent groups preferred as $R^{22}$ include acylamino groups containing from 1 to 10 carbon atoms (e.g., acetylamino, propionylamino, isobutyroylamino, hexahydrobenzoylamino, pivaloylamino, trifluoracetylamino, heptafluorobutyroylamino, chloropropionylamino, cyanoacetylamino, phenoxyacetylamino, acryloylamino, benzoylamino, p-trifluoromethylbenzoylamino, picolinoylamino, nicotinoylamino, isonicotinoylamino, thenoylamino, furoylamino).

Among the atoms and the substituent groups represented by $R^{23}$, $R^{27}$, $R^{28}$ and $R^{29}$, hydrogen atoms are preferred.

Among the substituent groups represented by $R^{24}$, preferred ones are acylamino groups represented by $R^{23}$, preferred ones are acylamino groups containing 2 to 8 carbon atoms and alkyl groups containing from 1 to 4 carbon atoms. AMong the atoms and the substituent groups represented by $R^{25}$, a hydrogen atom and halogen atoms are favored over others.

Among the atoms and the substituent groups represented by $R^{26}$, preferred ones are a hydrogen atom, alkyl groups containing 1 to 4 carbon atoms, alkoxy groups containing 1 to 4 carbon atoms, halogen atoms, acylamino groups containing 1 to 4 carbon atoms, sulfonylamino groups containing 1 to 4 carbon atoms, and alkoxycarbonylamino groups containing 2 to 5 carbon atoms.

$R^{30}$ and $R^{11}$ have the same meanings as $R^{11}$ and $R^{12}$. As for the preferred combination of $R^{30}$ and $R^{31}$, there are the case that both $R^{30}$ and $R^{31}$ are an unsubstituted alkyl group containing 1 to 6 carbon atoms, and the case that $R^{30}$ is an alkyl group containing 2 to 10 carbon atoms and a substituent group (e.g., cyano, alkoxy, hydroxy, acylamino, halogen, alkoxycarbonyl, alkoxycarbonyloxy, alkoxycarbonylamino, aminocarbonylamino, carbamoyl, acyloxy, acyl), and $R^{31}$ is an unsubstituted alkyl group containing 1 to 6 carbon atoms. $R^{30}$ and $R^{31}$ may combine with each other to form a ring, or $R^{30}$ may combine with $R^{27}$ to form a ring and/or $R^{31}$ may combine with $R^{28}$ to form a ring.

Specific examples of dyes represented by the general formula (IV) of this invention are illustrated below.

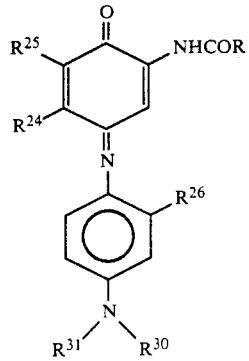

| Dye No. | R | $R^{24}$ | $R^{25}$ | $R^{26}$ | $R^{30}$ | $R^{31}$ |
|---|---|---|---|---|---|---|
| 114 | $-CH_3$ | $-CH_3$ | Cl | H | $C_2H_5$ | $C_2H_5$ |
| 115 | " | $-C_2H_5$ | " | " | " | " |
| 116 | $-C_2H_5$ | " | " | " | $C_3H_7$ | $C_3H_7$ |
| 117 | $-C_3H_7$-iso | $-CH_3$ | " | $CH_3$ | $CH_3$ | $CH_3$ |
| 118 | $-C_4H_9$-t | " | " | F | $C_4H_9$ | $C_4H_9$ |
| 119 | $-CH_3$ | $-C_2H_5$ | " | $-OCH_3$ | H | $C_2H_5$ |
| 120 | " | " | " | $-NHCOCH_3$ | " | " |
| 121 | " | " | " | $-NHCOOCH_3$ | $C_2H_5$ | $C_2H_4COOC_2H_5$ |
| 122 | 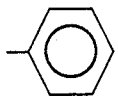 | " | " | H | " | $C_2H_5$ |
| 123 | " | $-CH_3$ | " | $CH_3$ | " | $C_2H_4CN$ |
| 124 | " | " | " | H | " | $C_2H_4OCH_3$ |
| 125 | 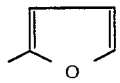 | " | " | " | " | $C_2H_5$ |
| 126 | 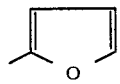 | $-C_2H_5$ | Cl | H | $C_2H_5$ | $C_2H_5$ |
| 127 | " | " | " | " | " | $C_2H_4OCH_3$ |
| 128 | " | " | " | " | " | $C_2H_4OCOCH_3$ |
| 129 | " | " | " | " | " | $C_2H_4OH$ |
| 130 | 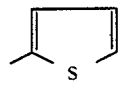 | " | " | " | " | $C_2H_5$ |
| 131 | 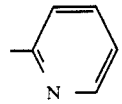 | " | " | " | " | " |
| 132 | 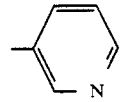 | " | " | " | " | " |

-continued

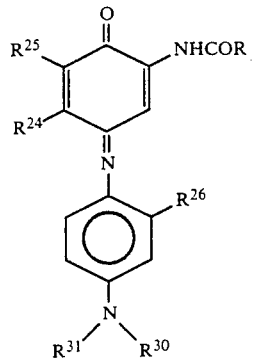

| Dye No. | R | $R^{24}$ | $R^{25}$ | $R^{26}$ | $R^{30}$ | $R^{31}$ |
|---|---|---|---|---|---|---|
| 133 | 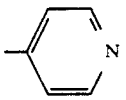 | " | " | " | " | " |
| 134 | 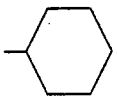 | $-CH_3$ | $-CH_3$ | $CH_3$ | $C_2H_4OCOCH_3$ | $C_2H_4OCOCH_3$ |
| 135 | 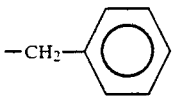 | $-C_2H_5$ | Cl | H | $C_2H_5$ | $C_2H_5$ |
| 136 | $-CF_3$ | $-NHCOCH_3$ | H | $CH_3$ | " | " |
| 137 | $-C_3F_7$ | " | " | H | " | " |
| 138 | $-CH_3$ | 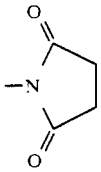 | " | " | " | " |
| 139 | 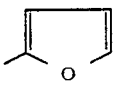 | $-NHCOC_3H_7$-iso | " | $CH_3$ | " | " |
| 140 | $-CH_3$ | H | " | " | " | " |

Particularly preferable compounds among those represented by general formula (IV) are Nos. 114, 115, 122, 125, 126, 127, and 128.

Dyes of general formula (IV) can be obtained by the oxidative coupling of compounds of general formula (XVI) with compounds of general formula (XVII), or by the dehydration-condensation relation of compounds of general formula (VIII) with compounds of general formula (XIX).

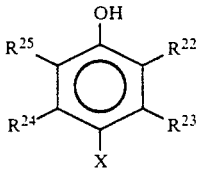

(XVI)

(X = H or a coupling-off group)

-continued

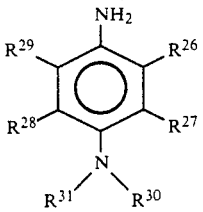

(XVII)

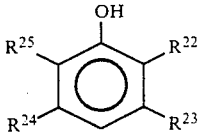

(XVIII)

-continued (XIX)

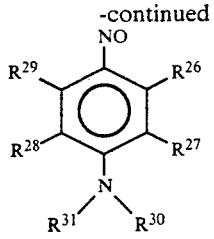

An amount of the dye represented by general formula (I), (II), and (III) or (IV) in the dye donating material of the present invention is preferably from 0.01 to 30 g/m$^2$, more preferably from 0.1 to 10 g/m$^2$.

A thermal transfer dye donating material yielding excellent color reproducibility and light fastness is obtained with these dyes. The combined use of these dyes and a fluorine containing compound in this invention makes it feasible to provide a thermal transfer dye donating material which not only gives excellent color reproducibility and light fastness, but also has high heat resistance and almost negligible creasing from deformation, and does not adhere to an image receiving material as a result of thermal fusion. The thermal transfer image recording method uses the above-described heat transfer dye donating material.

Fluorine containing compounds to be used in this invention may have either low or high molecular weight. Examples of fluorine containing compounds of low molecular weight include those disclosed in U.S. Pat. Nos. 3,775,126, 3,589,906, 3,798,265, 3,779,768 and 4,407937, West German Patent 1,293, 189, British Patent 1,259,398, JP-A-48-87826, JP-A-49-10722, JP-A-49-46733, JP-A-50-16525, JP-A-50-113221, JP-A-50-161236, JP-A-50-99525, JP-A-50-160034, JP-A-51-43131, JP-A-51-106419, JP-A-51-7917, JP-A-51-32322, JP-A-51-151125, JP-A-51-151126, JP-A-51-151127, JP-A-51-129229, JP-A-52-127974, JP-A-52-80023, JP-A-53-84712, JP-A-53-146622, JP-A-54-14224, JP-A-54-48520, JP-A-55-7762, JP-A-56-55942, JP-A-56-114944, JP-A-56-114945, JP-B-57-8456 (The term "JP-B" as used herein means an "examined Japanese patent publication"), JP-B-57-12130, JP-B-57-12135, JP-B-58-9408, and so on.

Examples of fluorine containing compounds of high molecular weight include compounds disclosed e.g., in U.S. Pat. Nos. 4,175,969, 4,087,394, 4,016,125, 3,676,123, 3,679,411 and 4,304,852, JP-A-52-129520, JP-A-54-158,222, JP-A-55-57842, JP-A-57-11342, JP-A-57-19735, JP-A-57-179837, *Kagaku Sohsetsu No.*27, *Atarashii Fusso Kagaku* (which means "Introduction to chemistry No. 27, New fluorine chemistry") edited by the Japanese Chemical Society (1980), and *Kinosei Ganfusso Kobunshi* (which means "Functional fluorine-containing macromolecules"), edited by Nikkan Kogyo Shinbun-sha (1982).

Besides being produced in accordance with the methods described in the above-cited references, these fluorine-containing compounds can generally be synthesized by fluorination of the corresponding hydrocarbons. As for the fluorination of hydrocarbons, a detailed description can be found, e.g., in *Shin Jikken Kacaku Kohza* (which means "New lectures on experimental chemistry"), vol. 14(1), pp. 308–331, Maruzene, Tokyo (1977).

In this invention, a fluorine-containing compound is incorporated in a constituent layer of a dye donating material including at least dye donating layer in an amount of generally from 0.001 to 3 g, preferably from 0.002 to 1 g, and more preferably from 0.005 to 0.5 g, per square meter of the material.

A fluorine-containing compound of the present invention is preferably incorporated in a dye donating layer of a thermal transfer dye donating material. A fluorine-containing compound of the present invention may be dissolved in a suitable solvent, or be dispersed in a binder resin which is the same kind of one used for the dye donating layer, and then may be coated on the surface of the dye donating layer of the thermal transfer dye donating material.

Fluorine-containing compounds which can be used in this invention include fluorine-containing surface active agents, fluorine-containing oils (or greases), and solid fine particles of fluorine-containing polymers. Examples of preferred ones are given below. (A) Fluorine-containing Surface Active Agents:

$CF_3-(CF_2)_6-COONH_4$ A-1

$CF_3-(CF_2)_3-(CH_2)_{10}-COONa$ A-2

$CF_3-(CF_2)_6-CON(C_2H_5)-(CH_2)_2-SO_3K$ A-3

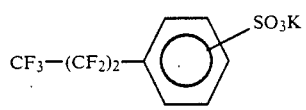

A-4

$CF_3-(CF_2)_7-SO_3K$ A-5

$CF_3-(CF_2)_{11}-CH_2-OSO_3Na$ A-6

$H(CF_2)_6-CH_2O(CH_2)_3SO_3Na$ A-7

$NaO_3S-CH(CH_2-CO_2CH_2-(CF_2)_6H)-CO_2CH_2-(CF_2)_6H$ A-8

$CH(CH_2-CO_2CH_2CF_2CF_2H)-CO(OC_2H_4)_4-O-CH(CH_2-CO_2CH_2CF_2CF_2H)-CO_2K$ A-9

$H-(CF_2)_{10}-CO_2Na$ A-10

$Cl(CF_2-CF(Cl))_3-CF_2-CO_2K$ A-11

$CF_3-(CF_2)_6-CH=CH-(CH_2)_3-CO_2Na$ A-12

$CF_3-(CF_2)_3-CF(CF_3)-(CH_2)_{10}-CO_2Na$ A-13

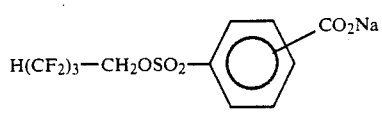

A-14

$CF_3-(CF_2)_7-CON(CH_3)-(CH_2)_2-CO_2Na$ A-15

$Cl(CF_2)_6-CO_2Na$ A-16

$CF_3-(CF_2)_3-CH_2CH_2SO_2N(C_2H_5)-CH_2CO_2Na$ A-17

$CF_3(CF_2)_7-SO_2N(C_2H_5)-CH_2CO_2K$ A-18

-continued

A-19

$$CF_3(CF_2)_7-SO_2N(C_3H_7)-CH_2CO_2K$$

A-20

$$C_{16}H_{33}-CH(SO_3Na)-CO_2CH_2CF_3$$

A-21

$$C_{16}H_{33}-CH(SO_3Na)-CONHCH_2-(CF_2)_2H$$

A-22

$$CF_3-C(C_2F_5)_2-C(CH_2O(CH_2CH_2O)_7H)-CHF-CH_3$$

A-23

$$CF_3-C(C_2F_5)_2-C(CO_2(CH_2CH_2O)_4H)-CHF-CF_3$$

A-24

$$CF_3-C(C_2F_5)_2-CH(CF_3)-CF(CF_3)-CO_2Na$$

A-25

$$CF_3-(CF_2)_7SO_2N(C_2H_5)-C_2H_4O-(C_2H_4O)_{10}H$$

A-26

$$H(CF_2)_{10}CH_2OH$$

A-27

$$CF_3-(CF_2)_6-CO_2(CH_2-CH(CH_3)-O)_4-(CH_2CH_2O)_{20}H$$

A-28

$$CF_3-(CF_2)_7SO_2N(CH_3)-CH_2CH_2OSO_3Na$$

A-29

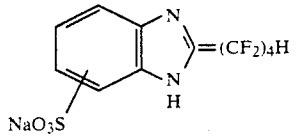

A-30

$$C_3F_{17}SO_2N(C_2H_5)-C_2H_4O-P(=O)(ONa)_2$$

A-31

$$H-(CF_2)_3-O-P(=O)(ONa)_2$$

A-32

$$CF_3-(CF_2)_{12}-CO_2-(C_2H_4O)_{20}H$$

A-33

$$CF_3-(CF_2)_6-CON(CH_3)-C_2H_4O-(C_2H_4O)_{20}H$$

A-34

$$F(CF(CF_3)-CF_2O)_2-CF(CF_3)-CONH(CH_2)_3CON(CH_3)_2$$

A-35

$$(CH_3CO_2)_2CH(CF_2)_6CF_3$$

-continued

A-36

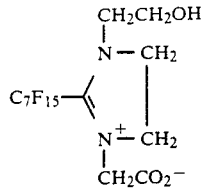

A-37

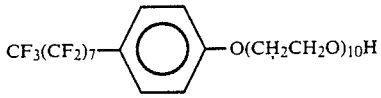

A-38

$$H-(CF_2)_6-CH_2O-(CH_2CH_2O)_{10}H$$

A-39

$$H-(CF_2)_6-CH_2O-(CH_2CH_2O)_{20}H$$

A-40

$$H-(CF_2)_6-CH_2O-(CH_2CH(OH)-CH_2O)_2-(CH_2CH_2O)_5H$$

A-41

$$CF_3(CF_2)_7-SO_2-NHCH_2CH_2-N^+(CH_2CH_3)_2-CH_2COO^-$$

A-42

$$CF_3(CF_3)_7SO_2NH(CH_2)_3-N^+(CH_2)_3I^-$$

A-43

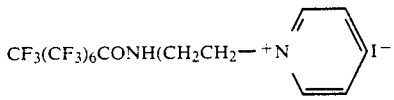

A-44

$$CF_3(CF_3)_6CONH(CH_2)_3-N^+(CH_3)_2-CH_2CH_2COO^-$$

A-45

$$C_8F_{17}SO_2N(C_2H_5)CH_2-CO(CH_2CH_2O)_{40}H$$

In addition to these surface active agents, Megafac F-171 to F-173, F-141 to F-144, F-170 to F-173, F-180 to F-184, F-192 to F-195, and F-522, produced by Dai-Nippon Ink & Chemicals, Inc.; Surflone S-111 to S-113, S-131 to S-133, S-141, S-101, S-105, S-381, and S-382, produced by Asahi Glass Co., Ltd.; Futergent 400S produced by Neos; are suitable examples.

Among these surface active agents, those of the betaine type are preferred.

(B) Fluorine-containing Oils (or Greases):

B-1

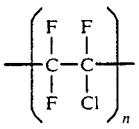

n = 4–12

B-2

$$F-(CF_2-CF_2-CF_2-O)_nCF_2CF_3$$

n = 10–60

B-3

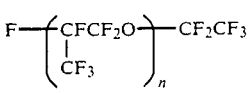

n = 10–60 n=10−60

(C) Solid Fine Particles of Fluorine-containing Polymers:

| | |
|---|---|
| Fine particles of tetrafluoroethylene resin | C-1 |
| Fine particles of tetrafluoroethylene/hexafluoropropylene copolymer | C-2 |

Various commercial products of these fine particles are on the market, e.g., Ruburon (produced by Dikin Kogyo Co., Ltd.), Teflon R (produced by Mitsui du Pont Fluoroochemicals, Co., Ltd.), and so on.

The size of solid fine particles of fluorine-containing polymers to be used in this invention ranges preferably from 0.01 to 20 μm, more preferably from 0.1 to 10 μm.

The thermal transfer dye donating material of this invention has on a support a dye donating layer containing the foregoing yellow, magenta and/or cyan dye(s), and the fluorine-containing compound.

The thermal transfer dye donating material can be used in the form of a sheet, a roll, or a ribbon. The yellow, magenta and cyan dyes of this invention are arranged so as to form their respective areas independently of one another. For instance, the yellow dye area, the magenta dye area and the cyan dye area are arranged over or on one and the same support in the planar or linear order. On the other hand, three separate dye donating materials can be prepared by providing on separate three supports the above-described yellow, magenta and cyan dyes, respectively. From these, thermal transfer of dyes can be performed successively from each of the separate three dye donating materials into a single thermal transfer image receiving material. Each of the yellow dye, magenta dye, cyan dye, and the fluorine-containing compound of this invention is dissolved or dispersed into an appropriate solvent together with a binder resin, and coated, or printed using a printing technique such as gravure method on a support. A dye donating layer containing these dyes in the present invention is controlled so as to have a dry thickness of generally from 0.1 to 10 μm, preferably 0.2 to 5 μm, more preferably from 0.4 to 2 μm.

As for the support of the thermal transfer dye donating material, any substance known in the art can be used. Examples include polyethylene terephthalate, polyamide, polycarbonate, glassine paper, condenser paper, cellulose esters, fluorine-containing polymers, polyethers, polyacetals, polyolefins, polyimide, polyphenylene sulfide, polypropylene, polysulfone, and cellophane.

The thickness of a support for the thermal transfer dye donating material is, in general, within the range of 2 to 30 μm.

As for the binder to be used with the dyes of this invention, any of binder resins well known in the art for such a purpose can be employed. Those having a high resistance to heat that do not disturb the transferring of dyes when they are heated are preferably chosen. For example, polyamide type resins, polyester type resins, epoxy resins, polyurethane type resins, polyacryl type resins (e.g., polymethylmethacrylate, polyacrylamide, styrene-2-acrylonitrile copolymer), vinyl resins including polyvinyl pyrrolidone, polyvinyl chloride type resins (e.g., vinyl chloride-vinyl acetate copolymer), polycarbonate type resins, polystyrene, polyphenylene oxide, polysulfone, cellulose type resins (e.g., methyl cellulose, ethyl cellulose, carboxymethyl cellulose, cellulose acetate hydrogen phthalate, cellulose acetate, cellulose acetate propionate, cellulose acetate butyrate, cellulose triacetate), polyvinyl alcohol type resins (e.g., polyvinyl alcohol, partially suponified polyvinyl alcohol such as polyvinyl acetal, polyvinyl butyral), petroleum type resins, rosin derivatives, cumarone-indene resin, terpene type resins, polyolefin type resins (e.g., polyethylene, polypropylene), can be used. Preferable binder resins in the present invention are polyester type resins, polyurethane type resins, polyacryl type resins, polycarbonate type resins, cellulose type resins, and polyvinyl alcohol type resins.

Binder resins in the present invention are preferably used in an amount of from 0.09 to 60 g per $m^2$ of the dye donating material.

Such binder resins are preferably used in an amount of about 80 to about 600 parts by weight per 100 parts by weight of the dyes.

As for the ink solvent for dissolving or dispersing the above-described dyes and binders, any known ink solvents can be freely used in this invention. Specific examples include alcohols such as methanol, ethanol, isopropyl alcohol, butanol, isobutanol, etc., ketones such as methyl ethyl ketone, methyl isobutyl ketone, cyclohexanone, etc., aromatic hydrocarbons such as toluene, xylene, etc., halogen-containing compounds such as dichloromethane, trichloroethylene, etc., dioxane, tetrahydrofuran, and mixtures of two or more thereof. It is important to select a solvent having the capacity to dissolve the dyes beyond a prescribed concentration, and to dissolve or disperse a binder resin to a satisfactory extent. For instance, the solvent is preferably used in an amount of approximately 9 to 20 times the total amount of the dyes and the binder resin.

A surface lubricant may be contained in the layer(s) to constitute a dye donating material and/or an image receiving material. This is particularly preferably in the outermost layers that are brought into face-to-face contact with each other, for the purpose of enhancing an ability to part the thermal transfer image receiving material from the thermal transfer dye donating material.

Examples of a surface lubricant usable herein include solid or waxy materials such as polyethylene wax, amide wax, etc.; surface active agents of phosphate type and so on; paraffin oils, silicone oils and the like; and other known surface lubricants. Among them, silicone oils are particularly preferable.

As for the silicone oils, modified ones such as carboxy-modified, amino-modified, and epoxy-modified silicone oils can be used, as well as nonmodified ones.

For instance, various kinds of modified silicone oils described in technical data published by Shin-etsu Silicone Co., Ltd., *Hensei Silicone Oils,* pp. 6–18B, can be noted. More specifically, when used together with binders soluble in organic solvents, amino-modified silicone oils which have groups capable of reacting with cross-linking groups of the binders (e.g., groups capable of reacting with isocyanate) are effective. When dispersed into a water-soluble binder in the form of emulsion, carboxy-modified silicone oils (e.g., X-22-3710, trade name, produced by Shin-etsu Silicone Co., Ltd.) are used to advantage.

Layers which constitute the thermal transfer dye donating material and the thermal transfer image receiving material to be used in this invention may be hardened by a hardener.

In hardening polymers soluble in organic solvents, hardeners disclosed in JP-A-61-199997, JP-A-58-215398 and so on can be used. As for the polyester resins, isocyanate type hardeners are preferably used.

In hardening water-soluble polymers, hardeners disclosed in U.S. Pat. No. 4,678,739 (column 41), JP-A-59-116655, JP-A-62-245261, JP-A-61-18942 and so on are suitable for use. Aldehyde type hardeners (e.g., formaldehyde), aziridine type hardeners, epoxy type hardeners (e.g.,

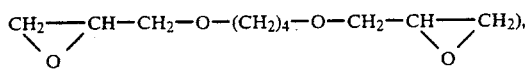

vinylsulfone type hardeners (e.g., N,N'-ethylenebis(-vinylsulfonylacetamido)ethane), N-methylol type hardeners (e.g., dimethylolurea), or polymeric hardeners (e.g., the compounds disclosed in JP-A-62-234157) are particularly preferred.

A discoloration inhibitor can be used in the thermal transfer dye donating material and the thermal transfer image receiving layer. Examples include antioxidants, ultraviolet absorbents, and certain kinds of metal complex salts.

Examples of antioxidants are chroman compounds, coumaran compounds, phenol compounds (e.g., hindered phenols), hydroquinone derivatives, and spiro indane compounds. In addition, the compounds disclosed in JP-A-61-159644 are effective, too.

Examples of ultraviolet absorbents are benzotriazole compounds (e.g., those disclosed in U.S. Pat. No. 3,533,794), 4-thiazolidone compounds (e.g., those disclosed in 3,352,681), benzophenone compounds (e.g., those disclosed in JP-A-56-2784), and the compounds disclosed in JP-A -54-48535, JP-A-62-136641, JP-A-61-88256, and so on. In addition, the ultraviolet absorbing polymers disclosed in JP-A-62-260152 are effective, too.

Examples of metal complexes are the compounds disclosed in U.S. Pat. Nos. 4,241,155, 4,245,018 (from column 3 to column 36) and 4,254,195 (from column 3 to column 8), JP-A-62-174741, JP-A-61-88256 (from page 27 to page 29), and Japanese Patent Application Nos. 62-234103, 62-31096 and 62-230596.

Specific examples of useful discoloration inhibitors are described in JP-A-62-215272 (from page 125 to page 137).

A discoloration inhibitor to prevent the dyes transferred into the image receiving layer from discoloring may be contained in advance in the image receiving material, or may be applied externally to the image receiving material, e.g., by the transfer from the dye donating material.

The above-described antioxidants, ultraviolet absorbents and metal complexes may be used in combinations of two or more. In constituent layers of the thermal transfer dye donating material and the thermal transfer image receiving material, various surface active agents can be used in addition to the fluorine-containing compounds of this invention for various purposes, e.g., as coating aids, for improvement in parting ability and slipping ability, for prevention of electrification, for acceleration of development, and so on.

Usable surface active agents include nonionic, anionic, amphoteric and cationic ones.

More specifically, nonionic surface active agents such as saponin (steroid type), alkylene oxide derivatives (e.g., polyethylene glycol, polyethylene glycol alkyl ethers, polyethylene glycol alkyl aryl ethers, polyethylene glycol esters, polyethylene glycol sorbitane esters, polyalkylene glycol alkylamines or amides, polyethylene oxide adducts of silicone), glycidol derivatives (e.g., alkenylsuccinic acid polyglycerides, alkylphenol polyglycerides), fatty acid esters of polyhydric alcohols, alkyl esters of sugars; anionic surface active agents containing acid groups (e.g., carboxyl group, sulfo group, phospho group, a sulfate group, a phosphate group), such as alkylcarboxylates, alkylsulfonates, alkylnaphthalenesulfonates, alkylsulfates, alkylphosphates, N-acyl-N-alkyltaurines, sulfosuccinates, sulfoalkylpolyethylene alkyl phenyl ethers, polyoxyethylene alkylphosphates; amphoteric surface active agents, such as amino acids, aminoalkylsulfonates, aminoalkylsulfates, aminoalkylphosphates, alkylbetaines, amine oxides; and cationic surface active agents, such as alkylamine salts, aliphatic or aromatic quaternary ammonium salts, heterocyclic quaternary ammonium salts like pyridinium, imidazolium, aliphatic or hetero ring-containing phosphonium or sulfonium salts can be used. Specific examples of these surface active agents are described in JP-A-62-173463, JP-A-62-183457.

In the thermal transfer dye donating material and the thermal transfer image receiving material, a matting agent can be used. Examples of suitable matting agents are silicon dioxide; the compounds disclosed in JP-A-61-88256 (page 29), such as polyolefin, polymethacrylate, : and the compounds disclosed in Japanese Patent Application Nos. 62-110064 and 62-110065, such as benzoguanamine resin beads, polycarbonate resin beads, AS resin beads.

When a printing operation is performed on the back side of the dye donating material, it is desirable that a treatment for prevention of sticking be given to the back side of the support, where any dye donating layer is provided, for the prevention of a sticking phenomenon arising from the heat of a thermal head, and for the enhancement of lubricity.

For instance, it is desirable to provide a heat-resisting slipping layer composed mainly of (1) products obtained by the reaction of a polyvinyl butyral resin with isocyanate, (2) an alkali or alkaline earth metal salt of a phosphoric acid ester, and (3) a bulking agent. As for the polyvinyl butyral resin, those which have a molecular weight of from 60,000 to 200,000, a glass transition point of from 80° C. to 110° C., and a vinyl butyral fraction of from 15 to 40 wt % from the viewpoint of an abundance of sites that react with isocyanate are preferred. As for the alkali or alkaline earth metal salts of phosphoric acid esters, Gafac RD 720 produced by Toho Chemical Industrial Co., Ltd. and so on can be used in a proportion of generally from 1 to 50 wt %, preferably from 10 to 40 wt %, to the polyvinyl butyral resin.

The heat-resisting slipping layer may be provided to prevent the tacky adhesion of the thermal head to the dye donating layer.

This heat-resisting slipping layer may contain a lubricating substance containing or not containing a polymer binder, e.g., a surfactant, solid or liquid lubricant, or a mixture thereof. As the binder for the heat-resisting slipping layer, a combination of a thermosetting synthetic resin and a suitable setting agent may be used, e.g., a combination of polyvinyl butyral with a polyisocyanate, a combination of acrylpolyol with a polyisocyanate, a combination of cellulose acetate with a titanium chelating agent, and a combination of polyester with an organic titanium compound. The heat-resisting slipping layer may comprise a slipping layer which function to prevent the tacky adhesion of the thermal head to the dye and a heat-resisting layer which has heat resistance.

In order to prevent the dyes from dispersing in the direction of the support, the dye donating layer is optionally provided with a hydrophilic barrier layer. The hydrophilic dye barrier layer contains a hydrophilic substance to prevent this. Excellent results can be obtained generally by using gelatin, polyacrylamide, polyisopropylacrylamide, butylmethacrylate grafted gelatin, ethylmethacrylate grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol with polyacrylic acid, or a mixture of cellulose monoacetate with polyacrylic acid. Among these hydrophilic substances, polyacrylic acid, cellulose monoacetate and polyvinyl alcohol are particularly favored over others.

The dye donating material may be provided with a subbing layer. In this invention, any subbing layer may be employed so long as it can fulfill a desired function. Specific examples of a substance suitable for the subbing layer include acrylonitrile/vinylidene chloride/acrylic acid (14:80:6 by weight) terpolymer, butylacrylate/2-aminoethylmethacrylate/2-hydroxyethylmethacrylate (30:20:50 by weight) terpolymer, linear/saturated polyester such as Bostic 7650 (Emhart Corp., Bostic Chemical Group), and chlorinated high density copoly(ethylene-trichloroethylene) resin. Coverage of the subbing layer, though does not have any particular limitation, and is generally from 0.1 to 2.0 g/m$^2$.

In forming the dye donating layers, it is desired that mark for positioning should be made simultaneously with the formation of any of the dye donating layers. This makes separate inking and printing steps other than those for formation of the dye donating layers, unnecessary.

Any support can be used for the thermal transfer image-receiving layer so long as it can withstand a transfer temperature, and meets requirements for smoothness, whiteness, lubricity, abrasion resistance, antistatic property, and prevention of generation of dents after transfer. Specific examples of supports which can be used include paper supports such as synthetic papers (e.g., those of polyolefin type, polystyrene type, etc.), wood free paper, art paper, coat paper, cast coat paper, wallpaper, paper for lining use, synthetic resin- or emulsion-impregnated paper, synthetic rubber latex-impregnated paper, synthetic resin-incorporated paper, paper board, cellulose fiber paper and polyolefin-coated paper (especially paper coated with polyethylene on both sides); films and sheets of various kinds of plastics such as polyolefins, polyvinyl chloride, polyethylene terephthalate, polystyrene, polymethacrylate and polycarbonate; films and sheets of the above-described plastics which have received in advance a white reflectivity imparting treatment; and laminates constructed by any combination of two or more of the above-described supports.

The thermal transfer image-receiving material is provided with an image-receiving layer. The image-receiving layer contains a dye-accepting substance alone, or together with a binding substance, which functions to accept thermal transfer dyes moving from the thermal transfer dye donating material to the image-receiving layer at the time of printing and can be dyed with the thermal transfer dyes. Such a layer is a coating having a thickness of preferably from about 0.5 to 50 μm, more preferably from 1 to 20 μm. The following dye-accepting polymers are preferable representative of the dye-accepting substance.

(a) Resins having ester linkages

Examples of these are polyester resins obtained by condensation of a dicarboxylic acid component such as terephthalic acid, isophthalic acid, succinic acid (which may be substituted by sulfo group, carboxyl group or so on), ethylene glycol, diethylene glycol, propylene glycol, neopentyl glycol, bisphenol A or the like; polyacrylate or polymethacrylate resins (such as polymethylmethacrylate, polybutylmethacrylate, polymethylacrylate, polybutylacrylate); polycarbonate resins; polyvinyl acetate resins; styreneacrylate resins; vinyltolueneacrylate resins; and so on can be instanced. Specific examples of these are described in JP-A-59-101395, JP-A-63-7971, JP-A-63-7972, JP-A-63-7973 and JP-A-60-294862. In addition, commercial products, such as those sold under the following trade names: Viron 290, Viron 200, Viron 280, Viron 300, Viron 103, Viron GK-140 and Viron GK-130 produced by Toyo Spinning Co. Ltd.; and ATR-2009 and ATR-2010 produced by Kao Soap Co., Ltd. can be used.

(b) Resins having urethane linkages

An example is polyurethane resin.

(c) Resins having amido linkages

An example is polyamide resin.

(d) Resins having urea linkages

An example is urea resin.

(e) Resins having sulfone linkages

An example is polysulfone resin.

(f) Resins having other linkages with high polarity

Examples are Polycaprolactone resin, styrene-maleic anhydride copolymer resin, polyvinyl chloride resin and polyacrylonitrile resin.

In addition to the above synthetic resins, mixtures of two or more of these, or copolymers of two or more of the monomers constituting these resins can be used.

Resins having ester linkages, resins having urethane linkages, and resins having amido linkages are more preferably used in the present invention.

A amount of the dye-accepting substance in the image receiving layer of the present invention is preferably from 0.5 to 50 g/m$^2$, more preferably from 1 g to 20 g/m$^2$.

In the thermal transfer image-receiving material, particularly in the image-receiving layer, high boiling organic solvents or thermal solvents can be used as a dye-accepting substance or a diffusion aid for dyes.

Specific examples of high boiling organic solvents and thermal solvents are disclosed in JP-A-62-174754, JP-A-62-245253, JP-A-61-209444, JP-A-61-200538, JP-A-62-8145, JP-A-62-9348, JP-A-62-30247, and JP-A-62-136646.

The image-receiving layer of the thermal transfer image-receiving material of this invention may bear a dye-accepting substance in a condition such that it is dispersed in a water-soluble binder. As binders usable in this case, known various water-soluble binders can be cited. In particular, water-soluble polymers having groups cross-linkable with hardeners (e.g., gelatin) are preferred.

The image-receiving layer may be constructed with two or more layers. It is to be desired that the layer located nearer to the support be designed to enhance the dyeing power of the dyes by using a synthetic resin having a low glass transition point, a high boiling organic solvent and/or a thermal solvent; and the outermost layer should be designed so as not to cause troubles, such as surface stickiness, adhesion to other materials, retransfer of the transferred dyes onto other materials, and blocking of the thermal transfer dye donating material by using a synthetic resin having a higher glass transition point, and further by using a high boiling organic solvent and a thermal solvent in minimal amounts, or without using such solvents.

The thickness of the image-receiving layer in the present invention is preferably from 0.5 to 50 μm, more preferably from 1 to 20 μm. In the two-layer construction, it is desirable that the outermost layer have a thickness of preferably from 0.1 to 2 μm, more preferably transfer image-receiving material may have an interlayer between the support and the image-receiving layer.

Depending on constituent substances, the interlayer can function as a cushion layer, a porous layer or a dye diffusion inhibiting layer, or it can be a layer retaining two or more of these functions. In some cases, it can function as an adhesive, too.

The dye diffusion inhibiting layer prevents certain thermal transfer dyes from diffusing into the support. As binders for the diffusion inhibiting layer, both water-soluble and organic solvent-soluble ones may be employed. However, water-soluble ones are preferred. Examples of these are the same as the water-soluble binders mentioned above as examples of binders for the image receiving layer. Among them, gelatin is particularly preferable.

The porous layer is a layer to fulfil a function of using effectively the heat applied at the time of thermal transfer by preventing the applied heat from being conveyed from the image-receiving layer to the support.

In the image-receiving layer, the cushion layer, the porous layer, the diffusion inhibiting layer, the adhesive layer and so on which constitute the thermal transfer image-receiving material of this invention, fine powders of silica, clay, talc, diatomaceous earth, calcium carbonate, calcium sulfate, barium sulfate, aluminium silicate, synthetic zeolite, zinc oxide, lithopone, titanium oxide, alumina, and/or so on may be contained.

The thermal transfer image-receiving material may contain a brightening agent. Examples of brightening agents are the compounds as described in K. Veenkataraman, *The Chemistry of Synthetic Dyes,* vol. 5, chap. 8, and JP-A-61-143752. More specifically, stilbene compounds, coumarin compounds, biphenyl compounds, benzoxazoline compounds, naphthalimide compounds, pyrazoline compounds, carbostyryl compounds, 2,5-dibenzoxazolethiophene compounds and so on can be cited.

The brightening agent can be used in combination with a discoloration inhibitor.

In constituent layers of the thermal transfer image-receiving material, an organic fluoro compounds may be contained, for example, to improve slippability, prevent electrification, and improve parting ability. Typical examples of organic fluoro compounds are fluorine-containing surfactants (for example those disclosed in JP-B-57-9053 (from column 8 to column 17), JP-A-61-20944 and JP-A-62-135826) and hydrophobic fluoro compounds (e.g., fluorine-containing oily compounds such as fluoro-oil, and solid fluoro-resins such as tetrafluoroethylene resin).

Coating compositions for dye donating material and image-receiving material of the present invention may be applied on a support, for example, by use of a reverse roll coater, a gravure coater, a microgravure coater, a rod coater, an air doctor coater, and a wire bar, etc..

In this invention, the thermal transfer dye donating material is brought into face-to-face contact with the thermal transfer image-receiving layer. Thermal energy corresponding to image information is applied to either side of the materials, preferably to the back side of the thermal transfer dye donating material, using a heating means such as a thermal head. This causes the dyes of the dye donating layer(s) to be transferred into the thermal transfer image-receiving material in proportional quantities to the thermal energy applied, resulting in the formation of a color image that is excellent in clearness, resolution and gradation.

The heating means is not limited to a thermal head. Laser beams (e.g., semiconductor laser), infrared flash, heat pen and other known heating means can be employed.

The combined use of the thermal transfer image-receiving material and the thermal transfer dye donating material permit this invention to be applied to printing using various thermal printing type printers, prints formed using facsimile, magnetic recording methods, photomagnetic recording methods, light recording methods, or for making prints from the screen of a television or CRT.

Additional details of thermal transfer recording methods are descried in JP-A-60-34895.

EXAMPLES

In the following examples using compounds of this invention and comparative compounds, the preparation of thermal transfer dye donating materials and thermal transfer image-receiving materials, the printing results using both materials, the tests applied to these materials and results of these tests are described.

EXAMPLE 1

Preparation of Thermal Transfer Yellow Dye Donating Material (I)

A 6 μm-thick polyethylene terephthalate film the back side of which had received such a treatment as to confer heat resistance and lubricity thereon (made by Teijin Limited) was used as a support. On the surface of this support was coated a coating composition of the following formula (1) for a thermal transfer dye donating layer in a dry thickness of 1.5 μm using a wire bar coating process. Thus, the thermal transfer yellow dye donating material (1) was prepared.

| Coating Composition (1) for Thermal Transfer Dye Donating Layer: | |
|---|---|
| Dye (No. 1) | 2.5 g |
| Polyvinyl butyral resin (Denka Butyral 5000-A made by Electro Chemical Industry Co., Ltd.) | 3 g |
| Toluene | 40 ml |
| Methyl ethyl ketone | 40 ml |
| Polyisocyanate (Takenate D110N, made by Takeda | 0.2 ml |

-continued

| |
|---|
| Coating Composition (1) for Thermal Transfer Dye Donating Layer: |
| Chemical Industries Co., Ltd.) |

Other thermal transfer dye donating materials of this invention, from (2) to (10), and materials for comparison, from (a) to (c), were prepared in the same manner as described above, except that dyes set forth in Table 1 were used in the place of dye (No. 1), respectively.

Preparation of Thermal Transfer Image-Receiving Material

Synthetic paper having a thickness of 150 ∞m (YUPO -FPG-150, made by Oji Yuka Synthetic Paper Co., Ltd.) was used as a base and, on the surface thereof, a coating composition of the following formula (1) for an image-receiving layer was coated to have a dry thickness of 8 μm using a wire bar coating process. After provision drying, the coated paper was placed in a 100° C. oven for 30 min. to complete the drying. Thus, the thermal transfer image-receiving material (1) was prepared.

TABLE 1

| Sample No. | Dye No. | Note | Hue |
|---|---|---|---|
| 1 | 1 | Invention | Yellow |
| 2 | 2 | Invention | Yellow |
| 3 | 30 | Invention | Magenta |
| 4 | 50 | Invention | Magenta |
| 5 | 51 | Invention | Magenta |
| 6 | 91 | Invention | Cyan |
| 7 | 93 | Invention | Cyan |
| 8 | 125 | Invention | Cyan |
| 9 | 126 | Invention | Cyan |
| 10 | 127 | Invention | Cyan |
| a | a | Comparison | Yellow |
| b | b | Comparison | Magenta |
| c | c | Comparison | Cyan |

Yellow Dye (a) for Comparison

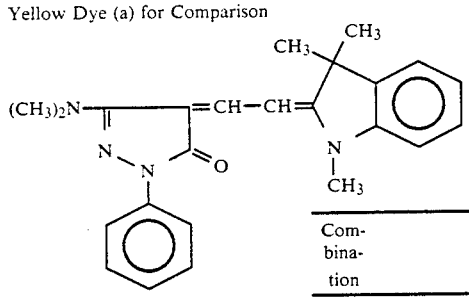

Magenta Dye (b) for Comparison

TABLE 1-continued

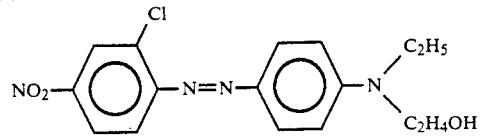

Cyan Dye (c) for Comparison

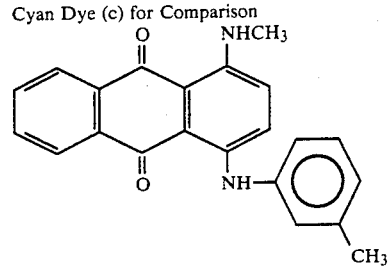

| Coating Composition (1) for Image-Receiving Layer: | |
|---|---|
| Polyester resin (Viron-280, made by Toyo Spinning Co., Ltd.) | 22 g |
| Polyisocyanate (KP-90, made by Dai-Nippon Ink & Chemicals, Inc.) | 4 g |
| Amino-modified silicone oil (KF-857, made by Shin-etsu Silicone Co., Ltd.) | 0.5 g |
| Methyl ethyl ketone | 85 ml |
| Toluene | 85 ml |
| Cyclohexanone | 15 ml |

The thus prepared thermal transfer dye donating materials relating to yellow, magenta and cyan dyes, respectively, were used in the combinations shown in Table 2. Each thermal transfer dye donating material was superposed on the thermal transfer image-receiving material so that the thermal transfer dye donating layer was brought into contact with the image-receiving layer. A thermal head having an output of 0.25 W/dot, a pulse width of 0.15–15 m sec, and a dot density of 6 dots/mm was used on the support side of the thermal transfer dye donating material. The yellow, magenta and cyan dyes were carried out in that order to image-wise dye the image-receiving layer, thus forming a full color image. In the above-described manner, image recording materials, from (I) to (V), and from (A) to (D), were obtained.

TABLE 2

| Combination | | Dye Donating Material No. | | | Max Reflection Density | | | Light Resistance of Gray Color Image (%) | | |
|---|---|---|---|---|---|---|---|---|---|---|
| | | Yellow | Magenta | Cyan | Yellow | Magenta | Cyan | Yellow | Magenta | Cyan |
| I | Invention | 1 | 3 | 6 | 1.8 | 2.0 | 1.7 | 92 | 93 | 93 |
| II | Invention | 2 | 4 | 7 | 1.7 | 2.1 | 1.6 | 90 | 92 | 92 |
| III | Invention | 1 | 5 | 8 | 1.9 | 1.9 | 1.8 | 93 | 90 | 94 |
| IV | Invention | 2 | 3 | 9 | 1.8 | 2.1 | 1.7 | 92 | 94 | 92 |
| V | Invention | 1 | 4 | 10 | 1.8 | 2.0 | 1.7 | 91 | 93 | 93 |
| A | Comprison | a | b | c | 1.7 | 1.9 | 1.6 | 85 | 87 | 82 |
| B | Comprison | 1 | b | c | 1.8 | 1.9 | 1.6 | 88 | 88 | 81 |
| C | Comprison | a | 3 | c | 1.8 | 2.0 | 1.7 | 86 | 89 | 85 |
| D | Comprison | a | b | 6 | 1.7 | 1.9 | 1.6 | 88 | 87 | 89 |

When comparison regarding clearness of colors was made among the image recording materials obtained, the red color image part of every recording material constructed in accordance with one of the combinations of this invention, from (I) to (V), was remarkably clearer and had higher purity than that of the recording material constructed in accordance with one of the comparative combinations, from (A) to (D). Similarly, the green and the blue color parts of this invention were also clearer.

In order to examine the stability of the color images obtained, all the completed thermal transfer image-receiving materials were placed in a light resistance testing machine equipped with a fluorescent lamp of 12,000 Lux over a 7-day period. Reflection densities were measured with a Status A filter before and after the test. Light resistance upon storage under daylight was evaluated using a ratio of the reflection density after the test to that before the test. The results obtained are shown in Table 2.

The light resistance of gray color images obtained using the combinations of this invention was excellent compared to the comparative examples.

EXAMPLE 2

Other combinations of thermal transfer dye donating materials were prepared in the same manner as in Example 1, except that the polyvinyl butyral resin in the coating compositions for the thermal transfer dye donating layers of Example 1 and the dyes therein were replaced by those shown in Table 3, respectively.

Full color printing was performed using the these thermal transfer dye donating materials and the same image-receiving material as prepared in Example 1. The recorded images were clear and free from transfer marks. These images also exhibited excellent light resistance.

TABLE 3

| No. | Resin | Dye No. Y | M | C |
|---|---|---|---|---|
| VI | Ethyl cellulose | 1 | 30 | 91 |
| VII | Cellulose acetate butyrate | 2 | 50 | 125 |
| VIII | Polysulfone | 1 | 51 | 127 |

EXAMPLE 3

Preparation of Thermal Transfer Image-Receiving Material (3)

Resin coated paper was prepared by laminating polyethylene on both sides of 200 μm-thick paper in thicknesses of 15 μm and 25 μm, respectively. On the side of the 15 μm-thick laminate, the coating composition of the following formula for an image-receiving layer was coated in a dry thickness of 10 μm using a wire bar coating process, and dried to prepare the thermal transfer image-receiving material (3).

| Coating Composition for Image-Receiving Layer: | |
|---|---|
| Polyester resin No. 1 | 25 g |
| Amino-modified silicone oil (KF857, made by Shin-etsu Silicone Co., Ltd.) | 0.8 g |
| Polyisocyanate (KP-90, made by Dai-Nippon Ink & Chemicals, Inc.) | 4 g |
| Methyl ethyl ketone | 100 ml |
| Toluene | 100 ml |
| Epoxy-modified silicone oil (KF-100T, made by Shin-etsu Silicone Co., Ltd.) | 0.5 g |
| Methyl ethyl ketone | 85 ml |
| Toluene | 85 ml |
| Cyclohexanone | 30 ml |

Polyester resin No. 1

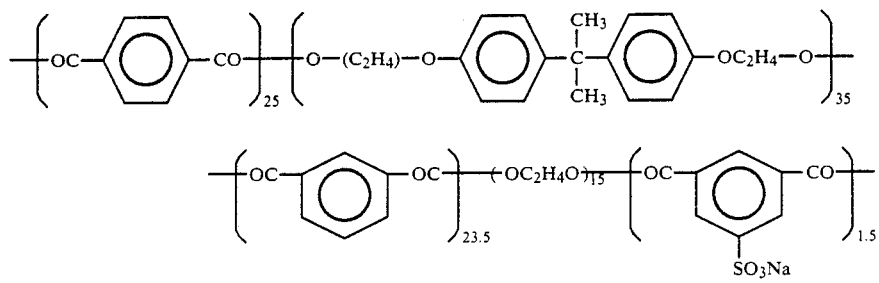

Full color printing was performed in the same manner as in Example 1. Clearly recorded images with high light resistance were obtained.

EXAMPLE 4

The coating composition for the thermal transfer yellow, magenta and cyan dye donating layers used in preparing the thermal transfer dye donating materials 1, 3 and 6, respectively, in Example 1 were coated in turn on one support in planar order to obtain a thermal transfer dye donating material with yellow, mangenta and cyan colors.

Image recording was performed using this thermal transfer dye donating material in the same manner as in Example 1. A clear image free from transfer marks was obtained. The maximum density of this printed image and the light fastness of the gray area were as good as those in combination I of Example 1.

EXAMPLE 5

Preparation of Dye-Accepting Polymer Emulsion A

| Composition of Solution I: | |
|---|---|
| Gelatin (19% aq. soln.) | 100 g |
| Sodium dodecylbenzenesulfonate (5% aq. soln.) | 50 ml |
| Water | 50 ml |
| Composition of Solution II: | |
| Polyester resin (1)* | 30 g |
| Toluene | 60 g |
| Methyl ethyl ketone | 60 g |
| Thermal solvent (1)* | 12 g |

Solution II was dissolved and added to Solution I with stirring. The resulting mixture was dispersed and emulsified using a homogenizer at 15,000 r.p.m. for 9 min. to prepare dye-accepting polymer emulsion A.

Polyester Resin (1)* : Viron 200 (made by Toyo Spinning Co., Ltd.)

Thermal Solvent (1)* : Diphenyl phthalate

Preparation of Dye-Accepting Polymer Emulsion B

Composition of Solution I:

-continued

| | |
|---|---|
| Gelatin (10% aq. soln.) | 100 g |
| Sodium dodecylbenzenesulfonate (5% aq. soln.) | 50 ml |
| Water | 50 ml |
| Composition of Solution II: | |
| Polyester resin (1)* | 30 g |
| Toluene | 60 g |
| Methyl ethyl ketone | 60 g |
| Thermal solvent (1)* | 12 g |
| Carboxy-modified silicone oil (1)* | 9 g |

Solutions I and II were converted into a thoroughly dissolved condition, and Solution I was added to Solution II with stirring. The resulting mixture was dispersed and emulsified using a homogenizer at 15,000 r.p.m. for 9 min. to prepare a dye-accepting polymer emulsion B.

Carboxy-Modified Silicone Oil (1)* : X-22-3710 (made by Shin-etsu Silicone Co., Ltd.)

Preparation of Coating Compositions for Image-Receiving Material

| | |
|---|---|
| First Layer: | |
| 10% Aq. solution of gelatin | 100 g |
| Water | 40 ml |
| Hardener (1)* (4% aq. soln.) | 60 ml |
| Hardener (1)*: 1,2-Bis(vinylsulfonylacetamido)ethane | |
| Second Layer: | |
| Dye-accepting polymer emulsion A | 100 g |
| Water | 50 ml |
| Third Layer (Outermost layer): | |
| Dye-accepting polymer emulsion B | 100 g |
| Water | 50 ml |
| Fluorine-containing surfactant (1)* (5% soln.) | 6 ml |
| Fluorine-Containing Surfactant (1)* | |
| $C_3F_7SO_2N(C_3F_7)CH_2COOK$ | |
| (water-methanol (1:1) mixed solution) | |

Preparation of Thermal Transfer Image-Receiving Material (4)

Paper having a basis weight of 180 g/m$^2$ and being laminated with polyethylene in which titanium oxide was dispersed in advance (thickness of polyethylene laminage: 30 μm) was used as a support. The coating compositions described above were applied on this support for the first to third layers in wet coverages of 20, 60 and 15 ml/m$^2$, respectively, followed by drying. Thus, the image receiving material (4) was prepared.

An image was formed using this image-receiving material (4) in the same manner as in Example 1. Similarly to the results of Example 1, the printed image produced by using the combination of dyes of this invention had higher maximum density, and higher resistance to light in the gray area.

EXAMPLE 6

Preparation of Thermal Transfer Dye Donating Materials

A 6 μm-thick polyethylene terphthalate film the back side of which had received such a treatment as to confer heat resistance and lubricity (made by Teijin Limited) was used as a support. On the surface of this support was coated a coating composition of the following formula for a thermal transfer dye donating layer, which contained one of the dyes and one of the fluorine-containing compounds shown in Table 4, in a dry thickness of 1.5 μm using a wire bar coating process. Thus, the following thermal transfer dye donating materials were prepared.

Coating Composition (11) for Thermal Transfer Dye Donating Layer:

| | |
|---|---|
| Dye | x g |
| Fluorine-containing compound | y g |
| Polyvinyl butyral resin (Denka Butyral 500-A made by Electro Chemical Industry Co., Ltd.) | 3 g |
| Toluene | 40 ml |
| Methyl ethyl ketone | 40 ml |
| Polyisocyanate (Takenate D110N, made by Takeda Chemical Industries Co., Ltd.) | 0.05 ml |

Preparation of Thermal Transfer Image-Receiving Material

Synthetic paper having a thickness of 150 μm (YUPO-FPG-150, made by Oji Yuka Synthetic Paper Co., Ltd.) was used as a base and, on the surface thereof, a coating composition of the following formula (11) for an image-receiving layer was coated so as to have a dry thickness of 8 μm using a wire bar coating process. After provision drying, the coated paper was placed in a 100° C. over for 30 min. to complete the drying. Thus, the thermal transfer image-receiving material (11) was prepared.

Coating Composition (11) for Image-Receiving Layer:

| | |
|---|---|
| Polyester resin (Viron-280, made by Toyo Spinning Co., Ltd.) | 22 g |
| Polyisocyanate (KP-90, made by Dai-Nippon Ink & Chemicals, Inc.) | 4 g |
| Amino-modified silicone oil (KF-857, made by Shin-etsu Silicone Co., Ltd.) | 0.5 g |
| Methyl ethyl ketone | 85 ml |
| Toluene | 85 ml |
| Cyclohexanone | 15 ml |

TABLE 4

| Dye Donatomg Material Sample No. | | Dye No. | Added Amount x (g) | Fluorine-containing Compound No. | Added Amount y (g) |
|---|---|---|---|---|---|
| 11 | Comparison | 1 | 3.5 | — | |
| 12 | Invention | 1 | 3.5 | A-19 | 0.3 |
| 13 | Comparison | 2 | 3 | — | |
| 14 | Invention | 2 | 3 | A-45 | 0.4 |
| 15 | Comparison | 30 | 3.3 | — | |
| 16 | Invention | 30 | 3.3 | B-2 | 0.3 |
| 17 | Invention | 50 | 3 | A-17 | 0.4 |
| 18 | Invention | 51 | 3 | C-1 | 0.5 |
| 19 | Comparison | 91 | 3.5 | — | |
| 20 | Invention | 91 | 3.5 | C-1 | 0.4 |
| 21 | Invention | 93 | 3 | A-45 | 0.3 |
| 22 | Comparison | 125 | 3 | — | |
| 23 | Invention | 125 | 3 | B-2 | 0.4 |
| 24 | Invention | 126 | 3.5 | A-3 | 0.5 |
| 25 | Invention | 127 | 3.5 | C-1 | 0.4 |
| 26 | Comparison | a | 2.5 | — | |
| 27 | Comparison | a | 2.5 | B-2 | 0.3 |
| 28 | Comparison | b | 3 | — | |
| 29 | Comparison | b | 3 | C-1 | 0.4 |
| 30 | Comparison | c | 3.5 | — | |
| 31 | Comparison | c | 3.5 | A-19 | 0.3 |

Each of the thus prepared thermal transfer dye donating materials was superposed on thermal transfer image-receiving material so that the thermal transfer dye donating layer might be brought into contact with the image-receiving layer. A thermal head having an output of 0.25 W/dot, a pulse width of 0.15–15 m sec, and a dot density of 6 dots/mm was used on the support side of the dye donating material and an imagewise recorded image was obtained in the image-receiving material.

When compared with the recorded images obtained using the comparative dye donating materials, those obtained in accordance with this invention exhibited excellent clearness of color. Further, fused adhesion of the dye donating layer to the image-receiving material was slight or non-existent. Recording troubles from creases resulting from deformation of the dye donating materials were also slight to non-existent.

In order to examine the stability of the color images obtained, all the completed thermal transfer image-receiving materials were placed in a light resistance testing machine equipped with a fluorescent lamp of 12,000 Lux over a 7-day period. Reflection densities were measured with an optical densitometer using a Status A filter before and after the test. Light resistance was evaluated based on the ratio of the reflection density after the test to that before the test. The results obtained are shown in Table 5.

In addition, transfer onto the same image-receiving material was repeated three times using the dye donating materials 12, 16 and 20 to obtain a recorded image of full color. This recorded image was clear, exhibited excellent color reproducibility, and was free from unevenness like creases.

TABLE 5

| Dye Donatomg Material Sample No. | | Max Reflection Density | Fused Adhension* | Crease* | Light Resistance (%) |
|---|---|---|---|---|---|
| 11 | Comparison | 1.8 | Δ | Δ | 92 |
| 12 | Invention | 1.8 | ⊙ | ○ | 93 |
| 13 | Comparison | 1.7 | x | Δ | 93 |
| 14 | Invention | 1.7 | ○ | ⊙ | 93 |
| 15 | Comparison | 2.0 | Δ | Δ | 93 |
| 16 | Invention | 2.0 | ⊙ | ⊙ | 94 |
| 17 | Invention | 2.1 | ○ | ⊙ | 92 |
| 18 | Invention | 1.9 | ⊙ | ○ | 90 |
| 19 | Comparison | 1.7 | Δ | x | 93 |
| 20 | Invention | 1.7 | ○ | ○ | 94 |
| 21 | Invention | 1.6 | ⊙ | ⊙ | 92 |
| 22 | Comparison | 1.8 | Δ | Δ | 94 |
| 23 | Invention | 1.8 | ⊙ | ⊙ | 94 |
| 24 | Invention | 1.7 | ○ | ⊙ | 93 |
| 25 | Invention | 1.7 | ○ | ○ | 92 |
| 26 | Comparison | 1.7 | Δ | x | 85 |
| 27 | Comparison | 1.7 | Δ | Δ | 85 |
| 28 | Comparison | 1.9 | Δ | Δ | 87 |
| 29 | Comparison | 1.9 | ○ | Δ | 88 |
| 30 | Comparison | 1.6 | Δ | Δ | 81 |

TABLE 5-continued

| Dye Donatomg Material Sample No. | | Max Reflection Density | Fused Adhension* | Crease* | Light Resistance (%) |
|---|---|---|---|---|---|
| 31 | Comparison | 1.6 | Δ | ○ | 82 |

Evaluation of the degrees of fused adhesion and crease:
*note
⊙: not caused at all
○: hardly caused
Δ: slightly caused
x: markedly caused

EXAMPLE 7

Other thermal transfer dye donating materials were prepared in the same manner as in Example 6, except that the polyvinyl butyral resin in the coating compositions for the thermal transfer dye donating layers of Example 6 was replaced with the resins shown in Table 6, respectively.

Thermal transfer was performed using the thus prepared thermal transfer dye donating materials and the same image-receiving material as prepared in Example 6. Clear recorded images free from transfer marks were obtained. These images also exhibited excellent light resistance.

TABLE 6

| Resin | Resin/Dye Ratio (by weight) |
|---|---|
| Ethyl cellulose | 1.0 |
| Cellulose acetate butyrate | 1.1 |
| Polysulfone | 0.8 |

EXAMPLE 8

Preparation of Thermal Transfer Image-Receivinq Material (12)

Resin coated paper was prepared by laminating polyethylene on both sides of 200 μm-thick paper in thicknesses of 15 μm and 25 μm, respectively. On the side of the 15μm-thick laminate, a coating composition of the following formula for an image-receiving layer was coated in a dry thickness of 10 μm using a wire bar coating process, and dried to prepare the thermal transfer image-receiving material (12).

Coating Composition for Image-Receiving Layer

| Coating Composition for Image-Receiving Layer: | |
|---|---|
| Polyester resin No. 1 | 25 g |
| Amino-modified silicone oil (KF857, made by Shin-etsu Silicone Co., Ltd.) | 0.8 g |
| Polyisocyanate (KP-90, made by Dai-Nippon Ink & Chemicals, Inc.) | 4 g |
| Methyl ethyl ketone | 100 ml |
| Toluene | 100 ml |
| Epoxy-modified silicone oil (KF-100T, made by Shin-etsu Silicone Co., Ltd.) | 0.5 g |
| Methyl ethyl ketone | 85 ml |
| Toluene | 85 ml |
| Cyclohexanone | 30 ml |

Polyester resin No. 1

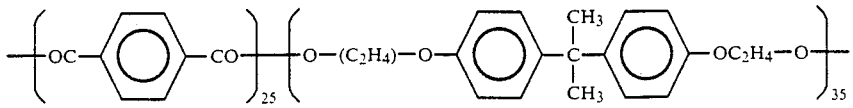

-continued

Polyester resin No. 1

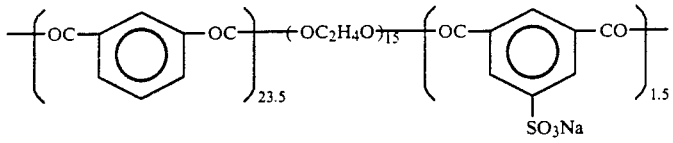

Thermal transfer was performed in the same manner as in Example 6 to obtain clearly recorded images which had high resistance to light, and did not exhibit creasing or fused adhesion.

EXAMPLE 9

Preparation of Thermal Transfer Image Receiving Material (14)

Into an aqueous gelatin solution having the following composition (C), a solution of a dye-accepting polymer in an organic solvent, having the following composition (D), was dispersed and emulsified with a homogenizer to prepare a gelatin dispersion of dye-accepting material. Aqueous solution of gelatin (C):

Polyester resin No. 1

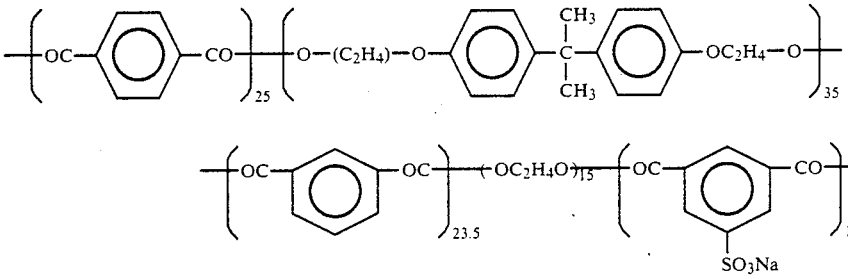

To the thus prepared dispersion was added a solution containing 0.5 g of fluorine-containing surfactant (a),

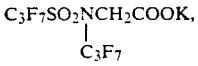

dissolved in 10 ml of a water-methanol (1:1) mixture to prepare a coating composition for an accepting layer.

This coating composition was coated on 150 μm-thick synthetic paper, the surface of which had undergone corona discharge (YUPO-SGG-150, made by Oji Yuka Synthetic Paper Co., Ltd.), in a dry thickness of about 6 μm using a wire bar coating process.

Thermal transfer was performed using those image-receiving material and dye-donating materials prepared according to Examples 6 and 7 to obtain images that did not exhibit creasing or fused adhesion and had excellent clarity and light resistance.

Further, as in Example 6, thermal transfer to the same image-receiving material was repeated three times using in turn the dye donating materials containing the yellow, magenta and cyan dyes of this invention, to obtain a full color recorded image which exhibited excellent color reproduction and was free from unevenness.

While the invention has been described in detailed with reference to specific embodiments, it will be apparent to one skilled in the art that various changes and modifications can be made to the invention without departing from its spirit and scope.

What is claimed is:

1. A method for recording a thermal transfer image comprising the step of transferring dyes contained in a thermal transfer dye donating material to an image receiving material in a quantity proportional to the amount of heat applied to said thermal transfer dye donating material or to said image receiving material, wherein said thermal transfer dye donating material comprises a yellow dye donating layer containing a yellow dye represented by general formula (I), a magenta dye donating layer containing a magenta dye represented by general formula (II), and a cyan dye donating layer containing at least one dye selected from the group consisting of a cyan dye represented by general formula (III) and a cyan dye represented by general formula (IV):

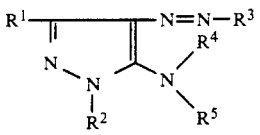

(I)

wherein $R^1$ represents a hydrogen atom, an alkyl group, an alkoxy group, an aryl group, an alkoxycarbonyl group, a cyano group, or a carbamoyl group;

$R^2$ represents a hydrogen atom, an alkyl group, or an aryl group;

$R^3$ represents an aryl group, or a heterocyclic group; and $R^4$ and $R^5$ each represent a hydrogen atom or an alkyl group;

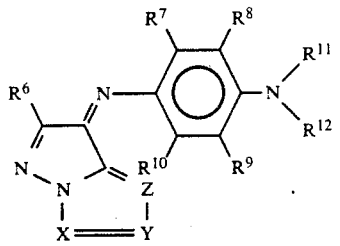

(II)

wherein $R^6$, $R^7$, $R^8$, $R^9$ and $R^{30}$ each represent a hydrogen atom, a halogen atom, an alkyl group, an alkoxy group, an aryl group, an aryloxy group, a cyano group, an acylamino group, a sulfonylamino group, an ureido group, an alkoxycarbonyl group, a carbamoyl group, a sulfamoyl group, a sulfonyl group, an acyl group, or an amino group;

$R^{11}$ and $R^{12}$ each represent a hydrogen atom, an alkyl group, or an aryl group; or $R^{11}$ and $R^{12}$ may combine with each other to form a ring, or $R^{11}$ may combine with $R^8$ to form a ring and/or $R^{12}$ may combine with $R^9$ to form a ring; and X, Y and Z each represent

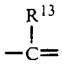

or a nitrogen atom, wherein R13 represents a hydrogen atom, an alkyl group, an aryl group, an alkoxy group, an aryloxy group, or an amino group; or when both X and Y, or both Y and Z are

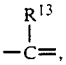

they may combine with each other to form a saturated or unsaturated carbon ring;

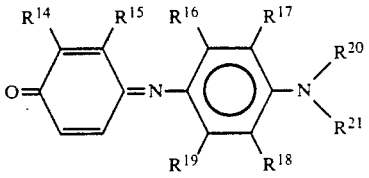

(III)

Q wherein

Q represents atoms necessary to complete a carbon ring having 5 or more member atoms, or a hetero ring having 5 or more member atoms including at least one nitrogen atom;

each substituent from $R^{14}$ to $R^{19}$ has the same meaning as each from $R^6$ to $R^{10}$;

$R^{20}$ and $R^{21}$ may combine each other to form a ring, or $R^{20}$ may combine with $R^{17}$ to form a ring and/or $R^{21}$ may combine with $R^{16}$ to form a ring;

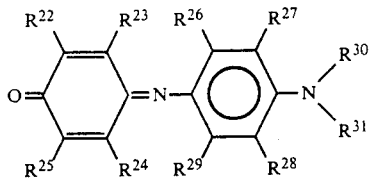

(IV)

wherein each substituent from $R^{22}$ to $R^{29}$ has the same meaning as each from $R^6$ to $R^{10}$; and $R^{30}$ and $R^{31}$ each have the same meaning as $R^{11}$ and $R^{12}$; or $R^{30}$ and $R^{31}$ may combine with each other to form a ring, or $R^{30}$ may combine with $R^{27}$ to form a ring and/or $R^{31}$ may combine with $R^{28}$ to form a ring.

2. A thermal transfer dye donating material comprising (a) a yellow dye donating layer containing a yellow dye represented by general formula (I), (b) a magenta dye donating layer containing a magenta dye represented by general formula (II), and (c) a cyan dye donating layer containing at least one dye selected from the group consisting of a cyan dye represented by general formula (III) and a cyan dye represented by general formula (IV);

wherein said yellow dye, magenta dye, and cyan dye donating layers each contain a fluorine compound and a binder:

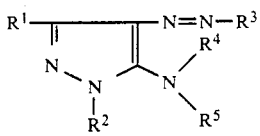

(I)

wherein $R^1$ represents a hydrogen atom, an alkyl group, an alkoxy group, an aryl group, an alkoxycarbonyl group, a cyano group, or a carbamoyl group;

$R^2$ represents a hydrogen atom, an alkyl group, or an aryl group;

$R^3$ represents an aryl group, or a heterocyclic group;

$R^4$ and $R^5$ each represent a hydrogen atom, or an alkyl group;

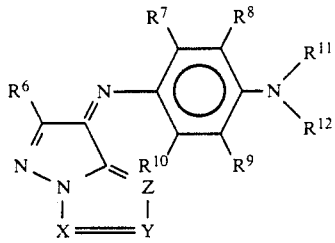

(II)

wherein $R^6$, $R^7$, $R^8$, $R^9$ and $R^{10}$ each represent a hydrogen atom, a halogen atom, an alkyl group, an alkoxy group, an aryl group, an aryloxy group, a cyano group, an acylamino group, a sulfonylamino group, an ureido group, an alkoxycarbonylamino group, an alkylthio group, a arylthio group, a alkoxycarbonyl group, a carbamoyl group, a sulfamoyl group, a sulfonyl group, an acyl group, or an amino group;

$R^{11}$ and $R^{12}$ each represent a hydrogen atom, an alkyl group, or an aryl group; or $R^{11}$ and $R^{12}$ may combine with each other to form a ring, or $R^{11}$ may combine with $R^8$ to form a ring and/or $R^{12}$ may combine with $R^9$ to form a ring; and X, Y and Z each represents

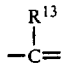

or a nitrogen atom, wherein $R^{13}$ represents a hydrogen atom, an alkyl group, an aryl group, an alkoxy group, an aryloxy group, or an amino group; or when both X and Y, or both Y and Z are

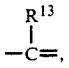

they may combine with each other to form a saturated or unsaturated carbon ring;

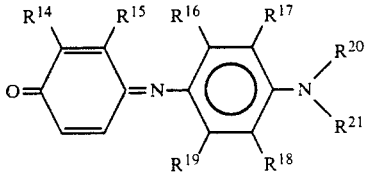

(III)

Q wherein

Q represents atoms necessary to complete a carbon ring having 5 or more member atoms, or a hetero ring having 5 or more member atoms including at least one nitrogen atom;

each substituent from $R^{14}$ to $R^{19}$ has the same meaning as each from $R^6$ to $R^{10}$;

$R^{20}$ and $R^{21}$ each have the same meaning as $R^{11}$ or $R^{12}$; or $R^{20}$ and $R^{21}$ may combine with each other to form a ring, or $R^{20}$ may combine with $R^{17}$ to form a ring and/or $R^{21}$ may combine with $R^{18}$ to form a ring;

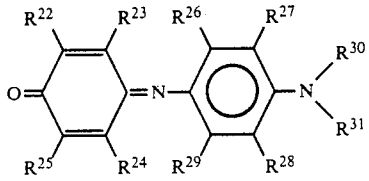

(IV)

wherein each substituent from $R^{22}$ to $R^{29}$ has the same meaning as each from $R^6$ to $R^{10}$; and $R^{30}$ and $R^{31}$ each have the same meaning as $R^{11}$ or $R^{12}$; or $R^{30}$ and $R^{31}$ may combine with each other to form a ring, or $R^{30}$ may combine with $R^{27}$ to form a ring and/or $R^{31}$ may combine with $R^{28}$ to form a ring.

3. The thermal transfer dye donating material of claim 2, wherein said dye donating layer contains from 0.001 to 3 g/m$^2$ of said fluorine-containing compound.

* * * * *